US010520206B2

(12) United States Patent
Xu et al.

(10) Patent No.: US 10,520,206 B2
(45) Date of Patent: Dec. 31, 2019

(54) WINDOW AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventors: Qiang Xu, Foshan (CN); Haiping Zhou, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 42 days.

(21) Appl. No.: 15/400,202

(22) Filed: Jan. 6, 2017

(65) Prior Publication Data

US 2017/0191679 A1 Jul. 6, 2017

(30) Foreign Application Priority Data

Jan. 6, 2016 (CN) ..... 2016 1 0011469
Jan. 6, 2016 (CN) ..... 2016 2 0018501 U
(Continued)

(51) Int. Cl.
*F24F 1/02* (2019.01)
*F24F 13/12* (2006.01)
(Continued)

(52) U.S. Cl.
CPC ..... *F24F 1/027* (2013.01); *E06B 7/02* (2013.01); *F24F 1/031* (2019.02); *F24F 13/12* (2013.01); *F24F 13/32* (2013.01)

(58) Field of Classification Search
CPC .. F24F 1/027; F24F 13/32; F24F 13/12; F24F 6/04; F24F 6/02; F24F 1/02; F24F 1/32;
(Continued)

(56) References Cited

U.S. PATENT DOCUMENTS 1,575,083 A * 3/1926 Tracy ..... E05D 15/0652 49/17
2,781,717 A * 2/1957 Hord ..... F24F 1/04 312/101
(Continued)

FOREIGN PATENT DOCUMENTS

CN 203404860 U 1/2014
CN 203757876 U 8/2014
CN 205351552 U 6/2016

OTHER PUBLICATIONS

Chinese Patent Application No. 201610029702.1, First Office Action dated Jan. 3, 2018, 10 pages.
(Continued)

*Primary Examiner* — Christopher R Zerphey
(74) *Attorney, Agent, or Firm* — Anova Law Group PLLC

(57) ABSTRACT

A window air conditioner is provided. The window air conditioner includes an air conditioner body; and a sealing plate assembly disposed at at least one side of the air conditioner body and including a fixed sealing plate group and a sliding sealing plate group connected with the fixed sealing plate group in a sealing manner, in which the fixed sealing plate group is disposed on a side wall of the air conditioner body, and the sliding sealing plate group is disposed at a side of the fixed sealing plate group away from the air conditioner body slidably in a direction approaching to or moving away from the air conditioner body.

20 Claims, 20 Drawing Sheets

(30) Foreign Application Priority Data

Jan. 14, 2016 (CN) ..... 2016 1 0029702
Jan. 14, 2016 (CN) ..... 2016 2 0039425 U

(51) Int. Cl.
*F24F 13/32* (2006.01)
*E06B 7/02* (2006.01)
*F24F 1/027* (2019.01)
*F24F 1/031* (2019.01)

(58) Field of Classification Search
CPC .... F24F 13/20; F24F 13/18; F24F 1/06; F24F 2006/006; F24F 2003/12667; F24F 1/031; F25D 23/12; E06B 7/18; E06B 3/4618; E06B 3/48; E06B 7/02; E05D 15/0652; E04B 2/827
USPC ..... 62/262
See application file for complete search history.

(56) References Cited

U.S. PATENT DOCUMENTS 2,830,336 A * 4/1958 Moore ..... E06B 7/2312 312/101
3,030,873 A * 4/1962 Metcalfe ..... F24F 1/04 248/208
3,134,319 A * 5/1964 Marsteller ..... F24F 1/04 454/203
3,296,820 A * 1/1967 Bauman ..... F24F 1/02 62/262
3,481,264 A * 12/1969 Ulich ..... F24F 1/04 454/203
3,587,441 A * 6/1971 Woods ..... E06B 9/0638 160/231.2
3,766,749 A * 10/1973 Livesay ..... F24F 1/027 62/262
3,811,370 A * 5/1974 Boston, Jr. ..... E06B 7/02 160/240
3,861,283 A * 1/1975 Shaner ..... F24F 1/04 454/203
3,911,990 A * 10/1975 Hoover ..... E06B 9/54 160/100
4,759,194 A * 7/1988 Shapiro ..... F24F 1/027 62/262
5,005,315 A * 4/1991 Jackson, Jr. ..... E04B 2/827 49/127
5,295,903 A * 3/1994 Bolton ..... F24F 1/027 454/201
5,341,860 A * 8/1994 Klein ..... F24F 13/20 150/165
5,979,533 A * 11/1999 Dupuie ..... F24F 1/0003 160/240
7,150,126 B2 * 12/2006 Rivera ..... B60J 5/06 49/62
7,350,759 B1 * 4/2008 Gray ..... F24F 1/027 248/644
7,743,557 B2 * 6/2010 Liao ..... E05D 15/0652 16/95 R
7,762,305 B2 * 7/2010 Huang ..... A47H 1/08 160/196.1
9,260,910 B1 * 2/2016 Flannery ..... E06B 9/00
2005/0072179 A1 * 4/2005 Wong ..... F24F 1/0003 62/412
2009/0031744 A1 * 2/2009 D'Souza ..... F24F 1/027 62/262
2016/0363330 A1 * 12/2016 Kim ..... F24F 1/025

OTHER PUBLICATIONS

Chinese Patent Application No. 201610029702.1, English translation of First Office Action dated Jan. 3, 2018, 13 pages.
Chinese Patent Application No. 201610029702.1, Second Office Action dated Sep. 17, 2018, 10 pages.
Chinese Patent Application No. 201610029702.1, English translation of Second Office Action dated Sep. 17, 2018, 14 pages.

* cited by examiner

WINDOW AIR CONDITIONER

RELATED APPLICATIONS

This application claims benefit of priority to (a) Chinese Patent Application No. 201610029702.1, filed with the State Intellectual Property Office on Jan. 14, 2016, (b) Chinese Patent Application No. 201610011469.4, filed with the State Intellectual Property Office on Jan. 6, 2016, (c) Chinese Patent Application No. 201620018501.7, filed with the State Intellectual Property Office on Jan. 6, 2016, and (d) Chinese Patent Application No. 201620039425.8, filed with the State Intellectual Property Office on Jan. 14, 2016. The entire content of each of the afore-mentioned applications is incorporated herein by reference.

FIELD

The present invention relates to a technical field of air conditioners, and particularly, to a window air conditioner.

BACKGROUND

The window air conditioner is usually installed in a window, and an accessory is needed in the installation of the window air conditioner. In related art, the installation accessory of the window air conditioner is an independent component separated from the window air conditioner, and includes an upper guiding track located on the top wall of a casing of the window air conditioner, a lower guiding track located below the bottom wall of the casing, a left curtain and a right curtain located at a left side and a right side of the casing respectively, and a left curtain frame and a right curtain frame to position the left curtain and the right curtain respectively. The upper guiding track and the lower guiding track are used to fix the whole window air conditioner and install the curtain frames, the curtain frame is a U-shaped frame disposed laterally, opening directions of the left curtain frame and the right curtain frame are opposed to each other, and the left curtain frame and the right curtain frame are inserted in the upper guiding track and the lower guiding track correspondingly and fixed to the window frame. The left curtain and the right curtain are disposed in the left curtain frame and the right curtain frame in a snap-fit manner correspondingly, one end of the curtain is connected with the casing of the window air conditioner in the snap-fit manner, and the other end thereof is fixed to the curtain frame after being drawn to its place.

When the window air conditioner is installed, since the accessories are disposed independently, respective accessories need to be installed respectively. For example, a shutter has a tedious installation process and at least two installers are needed to finish the installation together. In addition, the independent accessory is difficult to preserve, easy to lose during disassembling, and needs to be packaged during transportation, thus increasing costs of transportation and packaging. In addition, since the curtain is usually made of foldable soft materials, seams tend to appear around the curtain after the curtain has been installed to its place and water tends to leak in through the seams when it rains, thus influencing a use safety of the window air conditioner.

In addition, when the shutter is installed, a requirement of thermal insulation R1 value needs to be satisfied. However, in the related art, the shutter is configured as a thin PVC-extruded flexible curtain structure and cannot meet the R1 value requirement and the sealing requirement.

SUMMARY

The present invention aims to solve one of the technical problems above in the related art to at least some extent. Thus, one object of the present invention is to provide a window air conditioner, and the window air conditioner has advantages of a simple structure and a great sealing effect.

Embodiments of the present invention provide a window air conditioner, including an air conditioner body; and a sealing plate assembly disposed at at least one side of the air conditioner body and including a fixed sealing plate group and a sliding sealing plate group connected with the fixed sealing plate group in a sealing manner, in which the fixed sealing plate group is disposed on a side wall of the air conditioner body, and the sliding sealing plate group is disposed at a side of the fixed sealing plate group away from the air conditioner body slidably in a direction approaching to or moving away from the air conditioner body.

With the window air conditioner according to the embodiments of the present invention, by using the sliding sealing plate group slidable with respect to the fixed sealing plate group, a position of the sliding sealing plate group can be adjusted according to an installment environment of the window air conditioner, which is convenient for the sealing plate assembly to be suitable for different types of window frames, thus enlarging an application scope of the sealing plate assembly, reducing a stock amount of the sealing plate assembly, and saving a production cost. In addition, by connecting the fixed sealing plate group and the sliding sealing plate group in the sealing manner, an indoor environment and an outdoor environment are separated apart from each other effectively, and the heat exchange efficiency between the indoor environment and the outdoor environment is reduced, thus reducing power consumption of the window air conditioner and saving resources.

According to some embodiments of the present invention, the window air conditioner further includes a guiding assembly, in which the sliding sealing plate group is slidable with respect to the fixed sealing plate group through the guiding assembly.

According to some embodiments of the present invention, the guiding assembly includes a fixed guiding portion disposed on the air conditioner body and a sliding guiding portion slidably fitted with the fixed guiding portion, one part of the sliding sealing plate group is fixed in the sliding guiding portion, and the other part of the sliding sealing plate group is connected with the fixed sealing plate group in the sealing manner and slidably fitted with the fixed sealing plate group.

According to some embodiments of the present invention, the fixed guiding portion includes a first fixed member connected with the air conditioner body and the fixed sealing plate group in a snap-fit manner respectively.

According to some embodiments of the present invention, the first fixed member has a first snap at one side thereof and a second snap at the other side thereof, the first snap is connected with the air conditioner body in the snap-fit manner, and the second snap is connected with the fixed sealing plate group in the snap-fit manner, the air conditioner body has a first snap groove in the side wall thereof and the first snap groove is matched with the first snap, and the fixed sealing plate group has a second snap groove in an end portion thereof opposite to the first fixed member, and the second snap groove is matched with the second snap.

According to some embodiments of the present invention, a plurality of the first snap grooves is provided and spaced apart from one another along a length direction of the first fixed member.

According to some embodiments of the present invention, the first snap includes two first extending portions spaced apart from each other and extending out from a side of the first fixed member facing the air conditioner body, each first extending portion has a first snapping member at a free end thereof and two first snapping members extend away from each other, the air conditioner body has two side wings on the side wall thereof, the two side wings are spaced apart from each other and configured to form the first snap groove, and each side wing is configured to have a substantial L shape.

According to some embodiments of the present invention, two second snap grooves are provided and formed in two opposite side walls of the fixed sealing plate group respectively, the second snap includes two second extending portions spaced apart from each other and extending out from the first fixed member, each of the two second extending portions has a second snapping member at a free end thereof, and the second snapping members are protruded towards each other and matched with the second snap grooves.

According to some embodiments of the present invention, the fixed sealing plate group has an inclined surface between an end surface of the fixed sealing plate group facing the first fixed member and the second snap groove.

According to some embodiments of the present invention, the second snap groove is formed in an end surface of the fixed sealing plate group opposite to the first fixed member, and the second snap is configured to be a first protrusion protruded towards the fixed sealing plate group and matched with the second snap groove.

According to some embodiments of the present invention, in a direction from a fixed end of the first protrusion to a free end of the first protrusion, opposite side walls of the first protrusion fitted with the second snap groove are inclined towards each other gradually.

According to some embodiments of the present invention, a first snapping projection is formed on the side wall of the first protrusion fitted with the second snap groove, and a first concave portion fitted with the first snapping projection is provided in a position in the second snap groove opposed to the first snapping projection.

According to some embodiments of the present invention, the fixed guiding portion includes a second fixed member disposed on a top wall and/or a bottom wall of the air conditioner body, and the sliding guiding portion is slidably disposed on the second fixed member.

According to some embodiments of the present invention, one of the second fixed member and the sliding guiding portion has a guiding groove extending along a sliding direction of the sliding guiding portion, and the other thereof has a guiding sliding track matched with the guiding groove.

According to some embodiments of the present invention, the sliding guiding portion includes a first support plate slidably fitted with the fixed guiding portion, the first support plate has a first sliding groove and a second sliding groove disposed side by side along a front and rear direction, and the fixed sealing plate group is slidably fitted within the first sliding groove and the sliding sealing plate group is fixed within the second sliding groove.

According to some embodiments of the present invention, the sliding guiding portion further includes a second support plate paralleled to the first support plate and spaced apart from the first support plate in an up and down direction, in which the second support plate is slidably fitted with the fixed guiding portion; and a connecting plate connected between the first support plate and the second support plate, in which the sliding sealing plate group is connected with the connecting plate in a snap-fit manner.

According to some embodiments of the present invention, the connecting plate has a third snap, the sliding sealing plate group has a third snap groove in an end portion thereof opposite to the connecting plate, and the third snap groove is matched with the third snap.

According to some embodiments of the present invention, two third snap grooves are provided and formed in two opposite side walls of the sliding sealing plate group respectively, the third snap includes two third extending portions spaced apart from each other and extending out from the connecting plate towards the sliding sealing plate group, each of the two third extending portions has a third snapping member at a free end thereof, and the third snapping members are protruded towards each other and matched with the third snap grooves.

According to some embodiments of the present invention, a plurality of the third snaps is provided and spaced apart from one another along a length direction of the connecting plate.

According to some embodiments of the present invention, one third snap groove is provided and formed in an end surface of the sliding sealing plate group opposite to the connecting plate, and the third snap is configured to be a second protrusion protruded towards the sliding sealing plate group and matched with the third snap groove.

According to some embodiments of the present invention, in a direction from a fixed end of the second protrusion to a free end of the second protrusion, opposite side walls of the second protrusion fitted with the third snap groove are inclined towards each other gradually.

According to some embodiments of the present invention, a second snapping projection is formed on the side wall of the second protrusion fitted with the third snap groove, and a second concave portion fitted with the second snapping projection is provided in a position in the third snap groove opposed to the second snapping projection.

According to some embodiments of the present invention, the first support plate includes: a main plate; a plurality of side plates disposed at one side of the main plate and configured to define the first sliding groove and the second sliding groove; and a guiding plate disposed at the other side of the main plate and slidably fitted with the fixed guiding portion.

According to some embodiments of the present invention, the guiding plate is flush with one of the plurality of side plates.

According to some embodiments of the present invention, the sliding sealing plate group includes a plurality of sub sliding sealing plates and two adjacent sub sliding sealing plates are connected with each other in the sealing manner.

According to some embodiments of the present invention, the sub sliding sealing plate is configured as a PVC heat insulation plate.

According to some embodiments of the present invention, the fixed sealing plate group includes a plurality of sub fixed sealing plates and two adjacent sub fixed sealing plates are connected with each other in the sealing manner.

According to some embodiments of the present invention, the sub fixed sealing plate is configured as a PVC heat insulation plate.

According to some embodiments of the present invention, the two adjacent sub fixed sealing plates are connected with each other through a snap-fit assembly, and the snap-fit assembly includes a snapping groove disposed in one of the two adjacent sub fixed sealing plates and a third protrusion matched with the snapping groove and disposed on the other of the two adjacent sub fixed sealing plates.

According to some embodiments of the present invention, in a direction from a fixed end of the third protrusion to a free end of the third protrusion, opposite side walls of the third protrusion fitted with the snapping groove are inclined towards each other gradually.

According to some embodiments of the present invention, a third snapping projection is formed on the side wall of the third protrusion fitted with the snapping groove, and a third concave portion fitted with the third snapping projection is provided in a position in the snapping groove opposed to the third snapping projection.

According to some embodiments of the present invention, two sealing plate assemblies are distributed at two sides of the air conditioner body symmetrically.

According to some embodiments of the present invention, a sealing assembly is provided between the sliding sealing plate group and the fixed sealing plate group.

According to some embodiments of the present invention, the sealing assembly includes a sealing protruded strip extending along a length direction of the sliding sealing plate group and disposed on at least one of the sliding sealing plate group and the fixed sealing plate group, and a free end of the sealing protruded strip touches with the corresponding sliding sealing plate group or fixed sealing plate group.

According to some embodiments of the present invention, the sealing assembly is configured to be a sealing strip clamped between the sliding sealing plate group and the fixed sealing plate group, the sealing strip includes a U-shaped sealing groove, and the U-shaped sealing groove covers an end portion of the sliding sealing plate group toward the fixed sealing plate group or an end portion of the fixed sealing plate group toward the sliding sealing plate group.

According to some embodiments of the present invention, the sealing strip further includes a sealing edge strip extending along a length direction of the U-shaped sealing groove, and one end of the sealing edge strip is connected with the U-shaped sealing groove and the other end thereof touches with the sliding sealing plate group or the fixed sealing plate group.

Figure 1:
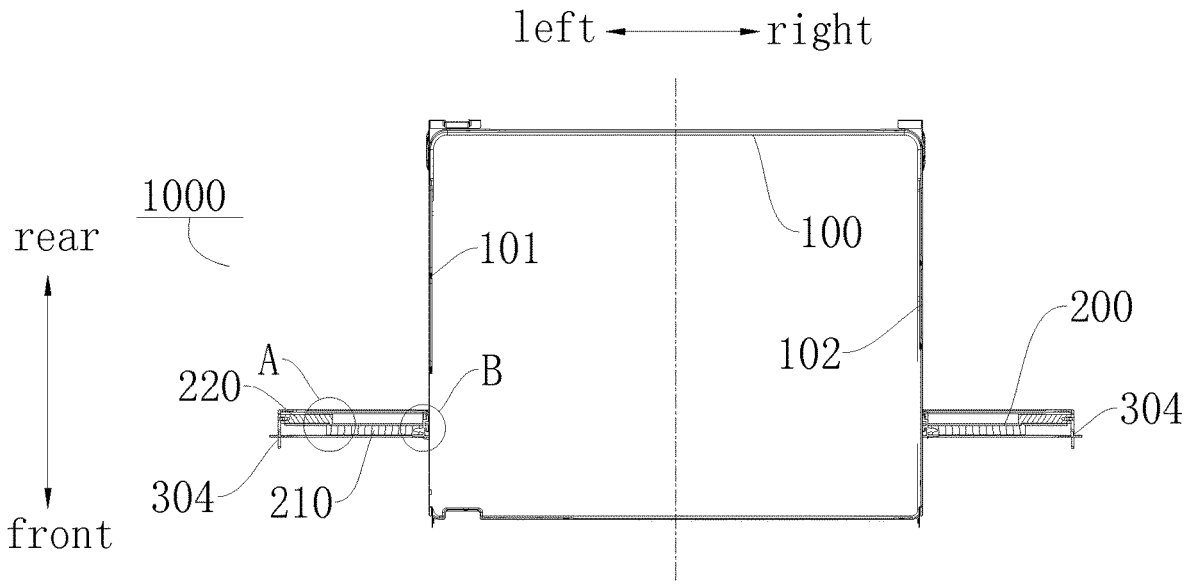
FIG. 1 is a schematic view of a window air conditioner according to an embodiment of the present invention.

REFERENCE NUMERALS window air conditioner 1000, air conditioner body 100, left side wall 101, right side wall 102, top wall 103, side wing 110, first snap groove 120, sealing plate assembly 200, sealing assembly 204, sealing protruded strip 201, sealing strip 202, sealing edge strip 203, fixed sealing plate group 210, second snap groove 211, inclined surface 212, first concave portion 213, sub fixed sealing plate 214, sliding sealing plate group 220, third snap groove 221, second concave portion 224, snap-fit assembly 230, snapping groove 231, third concave portion 232, third protrusion 233, third snapping projection 234, guiding assembly 300, fixed guiding portion 301, first fixed member 310, first snap 311, first extending portion 312, first snapping member 313, second snap 314, second extending portion 315, second snapping member 316, first protrusion 317, first snapping projection 318, sealing baffle 319, second fixed member 320, guiding groove 321, sliding guiding portion 304, guide sliding track 305, first support plate 340, first sliding groove 341, second sliding groove 342, main plate 343, side plate 344, guiding plate 345, second support plate 350, connecting plate 360, third snap 361, third extending portion 362, third snapping member 363, second protrusion 364, second snapping projection 365.

DETAILED DESCRIPTION

Embodiments of the present invention will be described in detail and examples of the embodiments will be illustrated in the accompanying drawings, where same or similar reference numerals are used to indicate same or similar members or members with same or similar functions. The embodiments described herein with reference to the drawings are explanatory, which aim to illustrate the present invention, but shall not be construed to limit the present invention.

In the specification, it shall be understood that terms such as "central," "longitudinal," "lateral," "length," "width," "thickness," "upper," "lower," "front," "rear," "left," "right," "vertical," "horizontal," "top," "bottom," "inner," "outer," "clockwise," and "counterclockwise" should be construed to refer to the orientation or position as then described or as shown in the drawings under discussion. These relative terms are for convenience of description and do not indicate or imply that the present invention must have a particular orientation, or be constructed or operated in a particular orientation, and thus shall not be construed to limit the present invention.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present invention, "a plurality of" means at least two such as two or three, unless specified otherwise.

In the present invention, unless specified or limited otherwise, the terms "mounted," "connected," "coupled," "fixed" and the like are used broadly, and may be, for example, fixed connections, detachable connections, or integral connections; may also be mechanical, electrical connections or can communicate with each; may also be direct connections or indirect connections via intervening structures; may also be inner communications or interaction of two elements, which can be understood by those skilled in the art according to specific situations.

In the present invention, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

In the following, a window air conditioner 1000 according to embodiments of the present invention will be described in detail with reference to FIG. 1 to FIG. 35.

As shown in FIG. 1 to FIG. 35, the window air conditioner 1000 according to embodiments of the present invention includes an air conditioner body 100 and a sealing plate assembly 200.

In particular, the window air conditioner 1000 is adapted to be installed to a window frame, and the air conditioner body 100 may be connected to the window frame in a sealing manner through the sealing plate assembly 200. The sealing plate assembly 200 is disposed at at least one side of the air conditioner body 100. It should to be noted that, the sealing plate assembly 200 can separate an indoor environment from an outdoor environment effectively, and reduce the heat exchange efficiency between the indoor environment and the outdoor environment, thus reducing power consumption of the window air conditioner 1000 and saving resources.

As shown in FIG. 1, the sealing plate assembly 200 may include a fixed sealing plate group 210 and a sliding sealing plate group 220 connected with the fixed sealing plate group 210 in a sealing manner. The fixed sealing plate group 210 is disposed on a side wall of the air conditioner body 100, and the sliding sealing plate group 220 is disposed at a side of the fixed sealing plate group 210 away from the air conditioner body 100 slidably in a direction approaching to or moving away from the air conditioner body 100. It should be noted that, by using the slidable sliding sealing plate group 220 to adjust a distance between the air conditioner body and the window frame, not only the window air conditioner 1000 is convenient to be installed to the window frame, an application scope of the sealing plate assembly 200 is also enlarged, so that the sealing plate assembly 200 is suitable for different installation conditions, thus reducing a stock amount of the sealing plate assembly 200 and saving a production cost. In addition, by connecting the fixed sealing plate group 210 and the sliding sealing plate group 220 in the sealing manner, the indoor environment and the outdoor environment are separated effectively, and the heat exchange efficiency between the indoor environment and the outdoor environment is reduced, thus reducing the power consumption of the window air conditioner 1000 and saving resources.

For example, as shown in FIG. 1, FIG. 4, FIG. 6 and FIG. 9, two sets of the sealing plate assembly 200 are provided and disposed on a left side wall 101 and a right side wall 102 of the air conditioner body 100 respectively. In particular, in the sealing plate assembly 200 located on the left side wall 101 of the air conditioner body 100, the fixed sealing plate group 210 is connected with the left side wall 101 of the air conditioner body 100 in the sealing manner, and the sliding sealing plate group 220 is slidable with respect to the fixed sealing plate group 210 along a left and right direction (the left and right direction shown in FIG. 1) and connected with the fixed sealing plate group 210 in the sealing manner; in the sealing plate assembly 200 located on the right side wall 102 of the air conditioner body 100, the fixed sealing plate group 210 is connected with the right side wall 102 of the air conditioner body 100 in the sealing manner, and the sliding sealing plate group 220 is slidable with respect to the fixed sealing plate group 210 along the left and right direction (the left and right direction shown in FIG. 1) and connected with the fixed sealing plate group 210 in the sealing manner.

With the window air conditioner 1000 according to the embodiments of the present invention, by using the sliding sealing plate group 220 slidable with respect to the fixed sealing plate group 210, a position of the sliding sealing plate group 220 can be adjusted according to an installment environment of the window air conditioner 1000, which is convenient for the sealing plate assembly 200 to be suitable for different types of window frames, thus enlarging the application scope of the sealing plate assembly 200, reducing the stock amount of the sealing plate assembly 200, and saving the production cost. In addition, by connecting the fixed sealing plate group 210 and the sliding sealing plate group 220 in the sealing manner, the indoor environment and the outdoor environment are separated effectively, and the heat exchange efficiency between the indoor environment and the outdoor environment is reduced, thus reducing the power consumption of the window air conditioner 1000 and saving resources.

Figure 30:
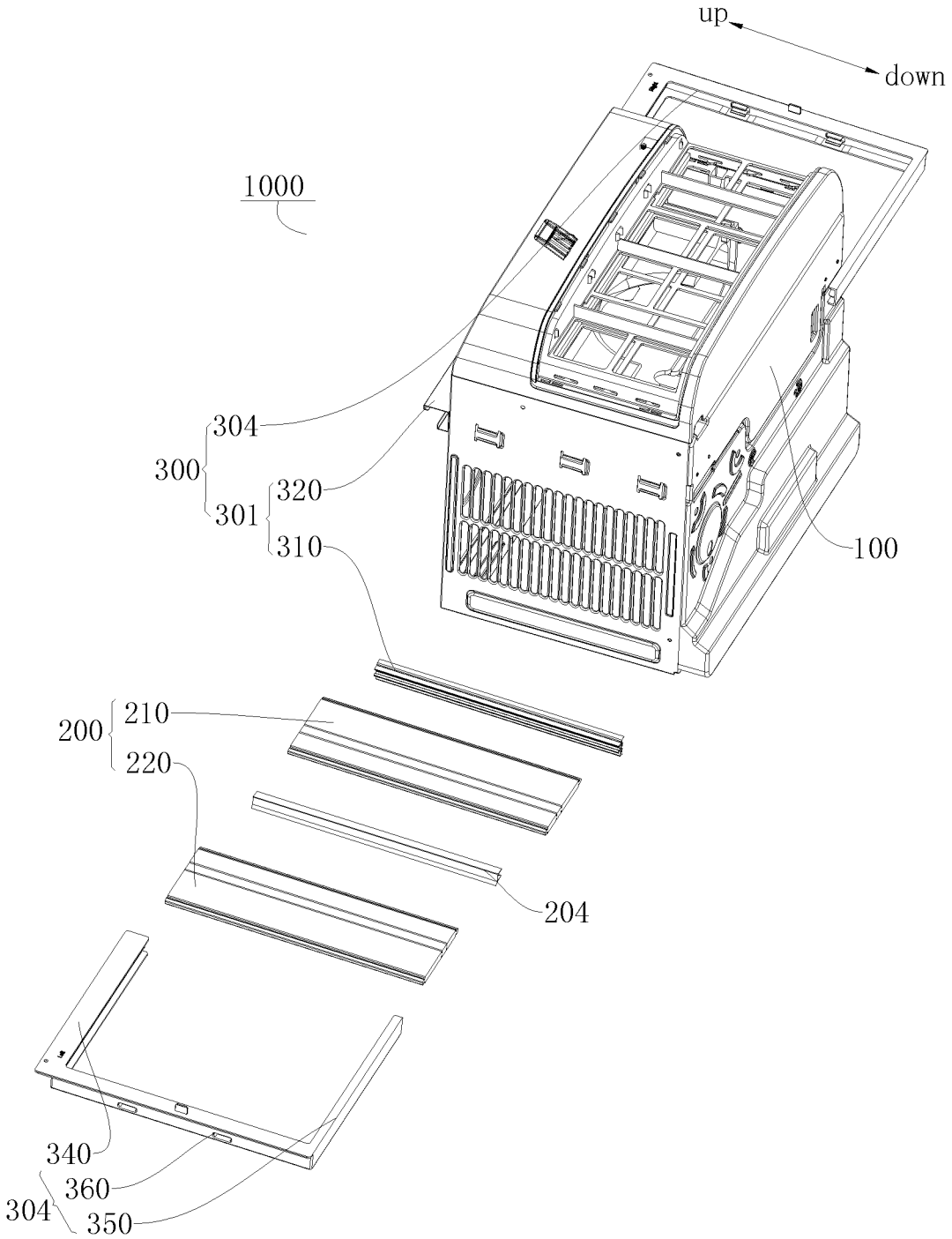
FIG. 30 is an exploded view of a window air conditioner according to an embodiment of the present invention.

According to an embodiment of the present invention, as shown in FIG. 30, the window air conditioner 1000 may further include a guiding assembly 300, in which the sliding sealing plate group 220 is slidable with respect to the fixed sealing plate group 210 through the guiding assembly 300. In an installation process of the window air conditioner 1000, the guiding assembly 300 is used to adjust a position of the sliding sealing plate group 220 with respect to the fixed sealing plate group 210, which is convenient for the sealing plate assembly 200 to be suitable for different installation environments, and further for the window air conditioner 1000 to be installed.

Figure 19:
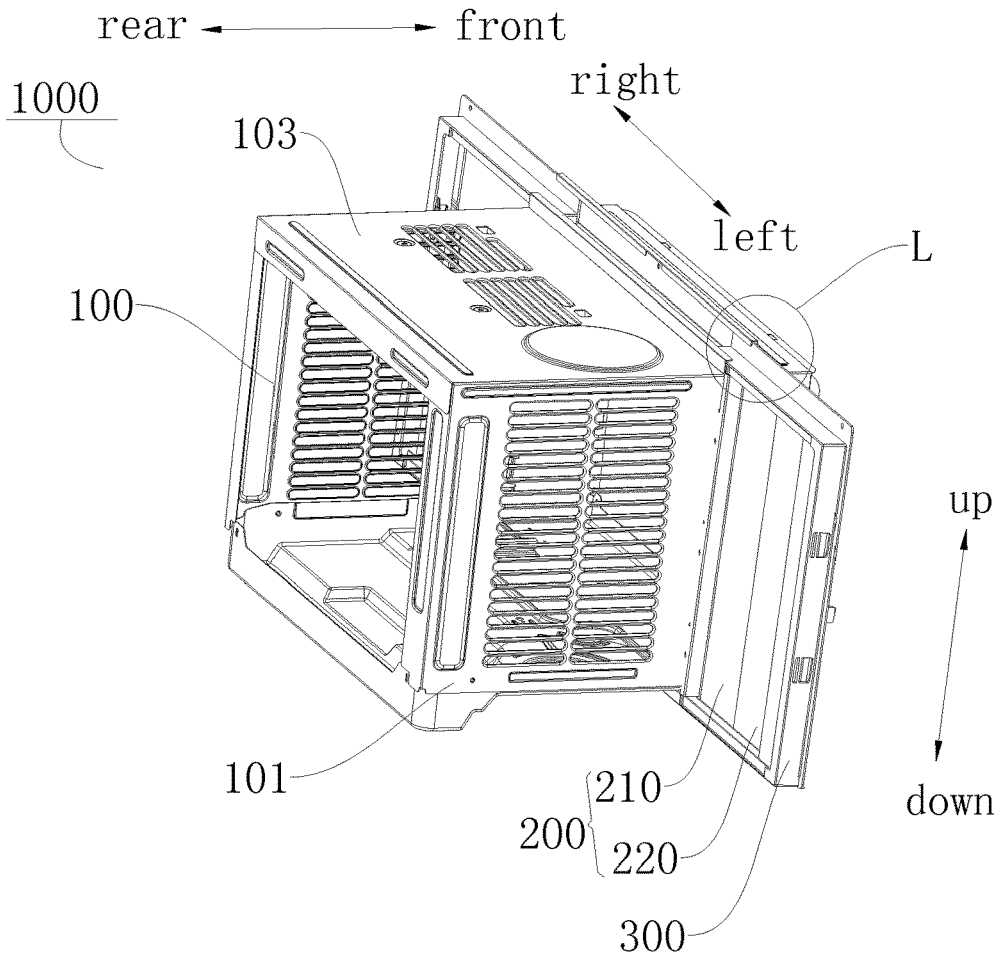
FIG. 19 is a perspective view of a window air conditioner according to an embodiment of the present invention.
Figure 20:
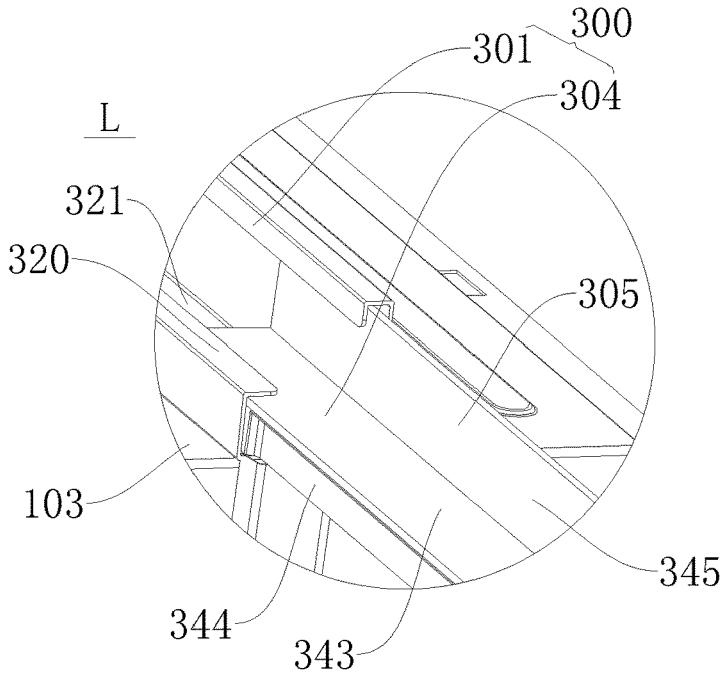
FIG. 20 is a partially enlarged view of portion L in FIG. 19.
Figure 21:
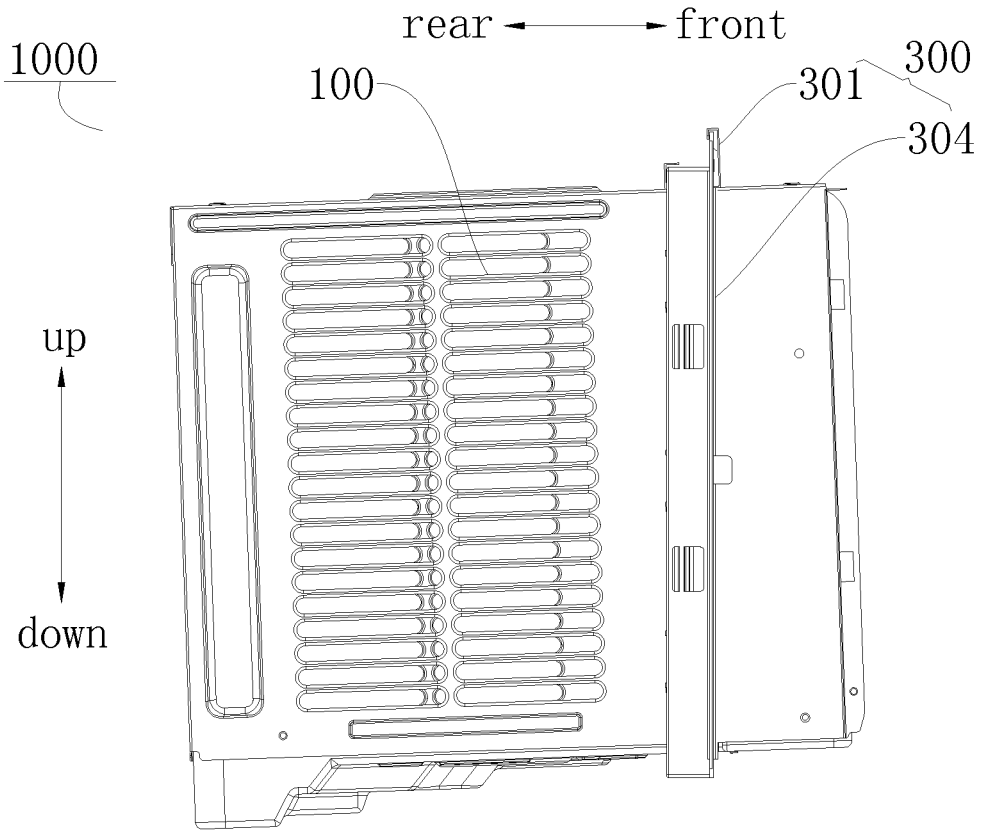
FIG. 21 is a left view of a window air conditioner according to an embodiment of the present invention.
Figure 22:
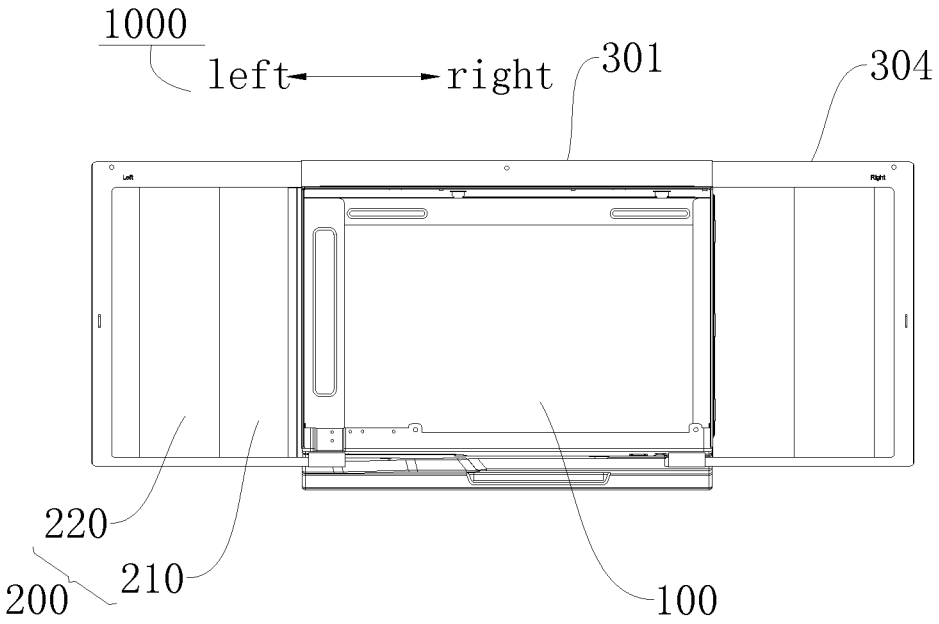
FIG. 22 is a front view of a window air conditioner according to an embodiment of the present invention.
Figure 23:
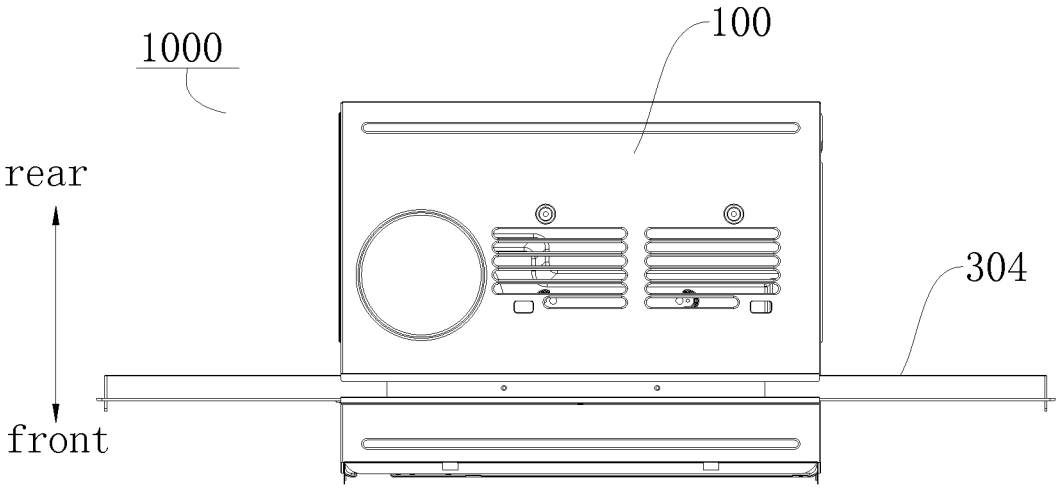
FIG. 23 is a top view of a window air conditioner according to an embodiment of the present invention.
Figure 24:
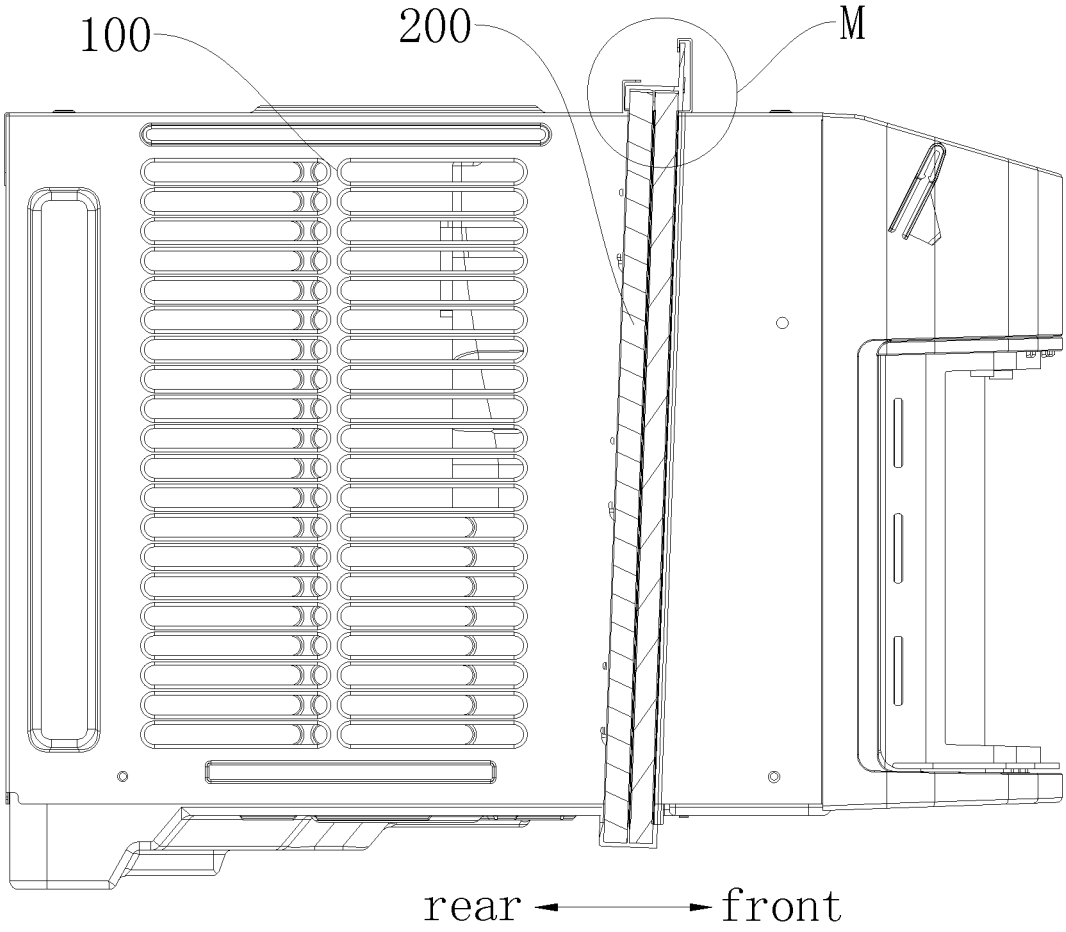
FIG. 24 is a section view of a window air conditioner according to an embodiment of the present invention.
Figure 25:
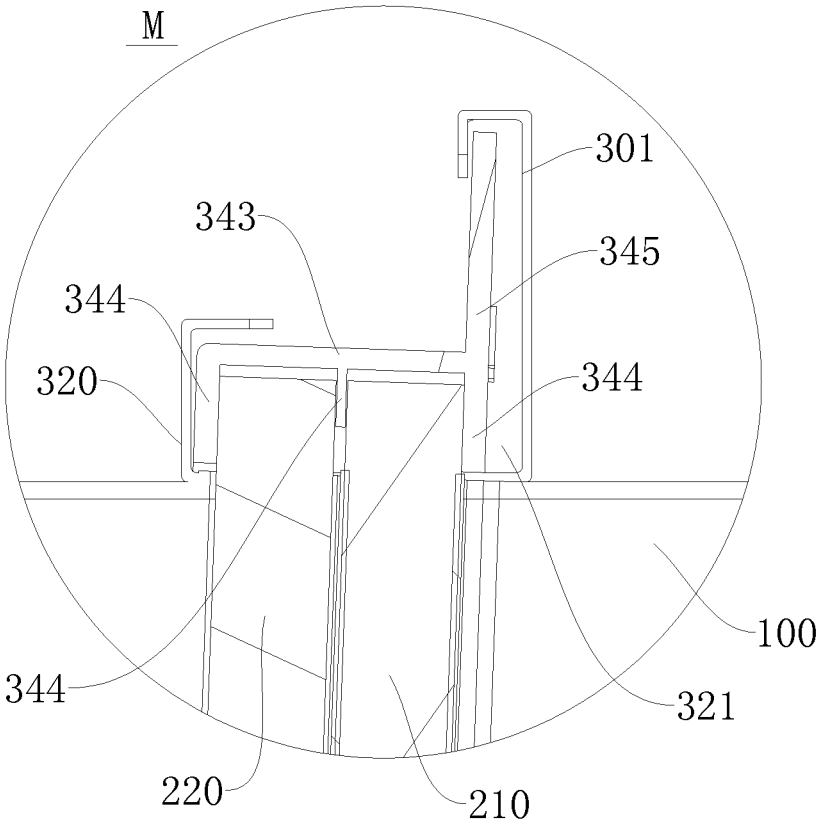
FIG. 25 is a partially enlarged view of portion M in FIG. 24.

According to an embodiment of the present invention, as shown in FIG. 19 to FIG. 20 and FIG. 30, the guiding assembly 300 includes a fixed guiding portion 301 disposed on the air conditioner body 100 and a sliding guiding portion 304 slidably fitted with the fixed guiding portion 301. One part of the sliding sealing plate group 220 is fixed in the sliding guiding portion 304, and the other part of the sliding sealing plate group 220 is connected with the fixed sealing plate group 210 in the sealing manner and slidably fitted with the fixed sealing plate group 210. It should be noted that, the fixed guiding portion 301 may be used to guide the sliding guiding portion 304, such that the sliding guiding portion 304 slides along a preset sliding direction and is prevented from deviating from the preset direction, thereby improving a structural stability of the guiding assembly 300.

Figure 3:
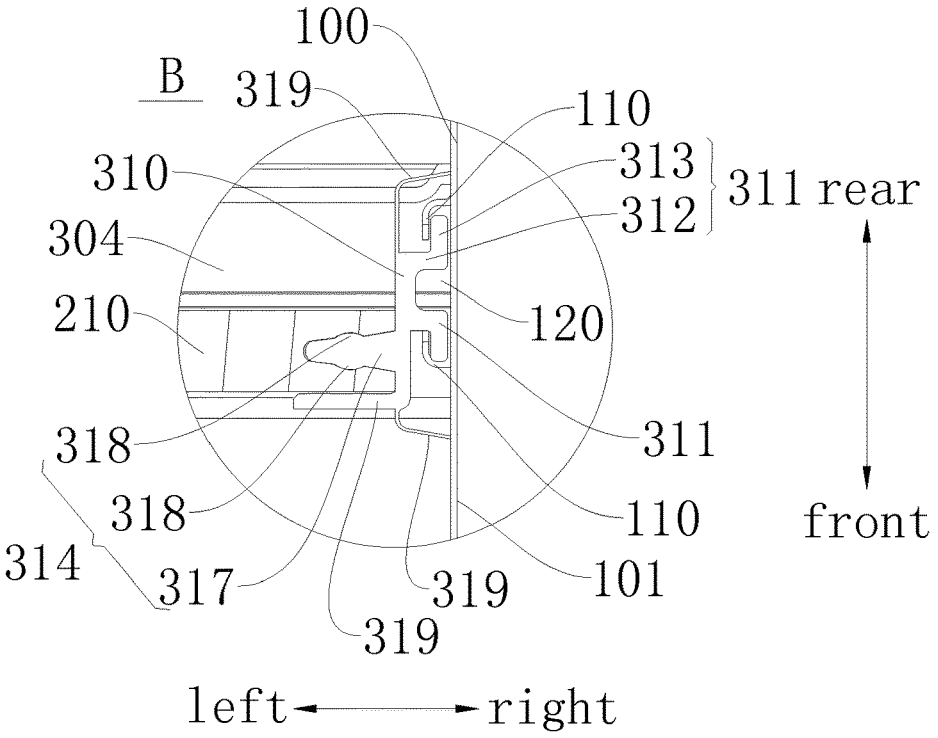
FIG. 3 is a partially enlarged view of portion B in FIG. 1.
Figure 4:
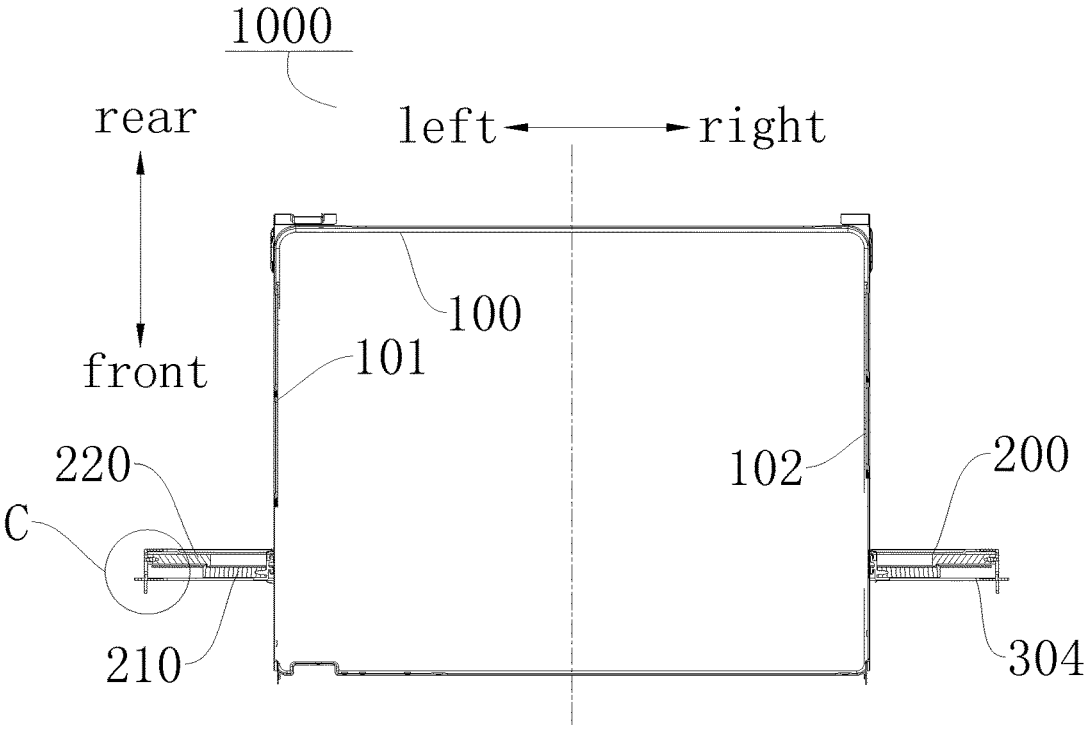
FIG. 4 is a schematic view of a window air conditioner according to an embodiment of the present invention.
Figure 8:
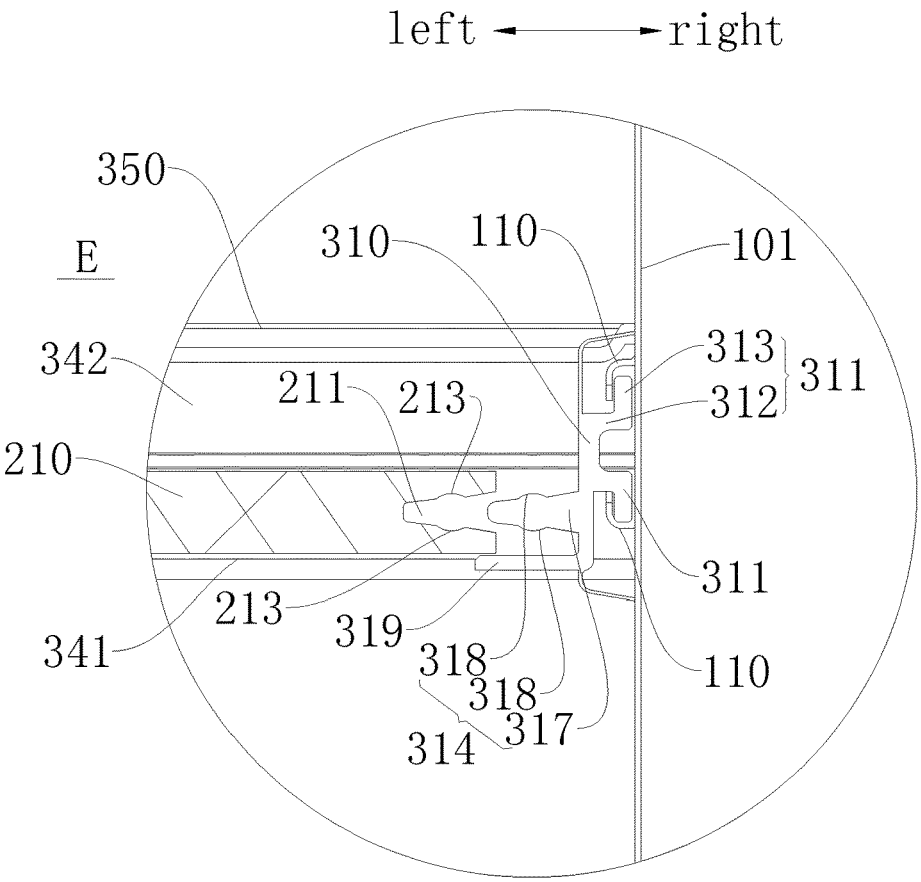
FIG. 8 is a partially enlarged view of portion E in FIG. 6.
Figure 28:
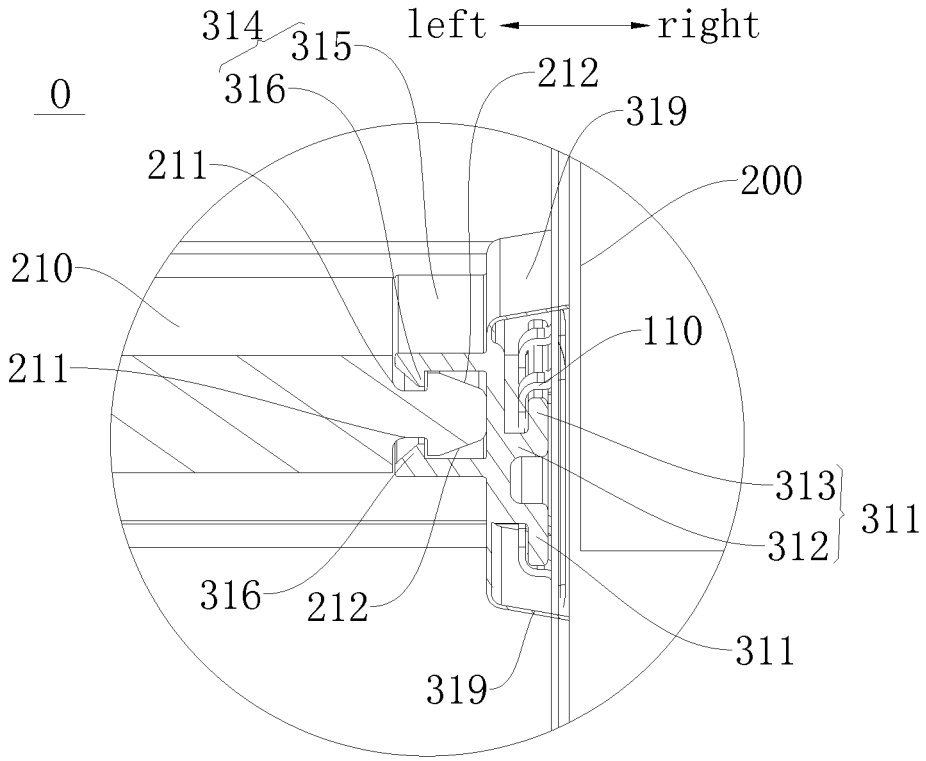
FIG. 28 is a partially enlarged view of portion O in FIG. 26.
Figure 29:
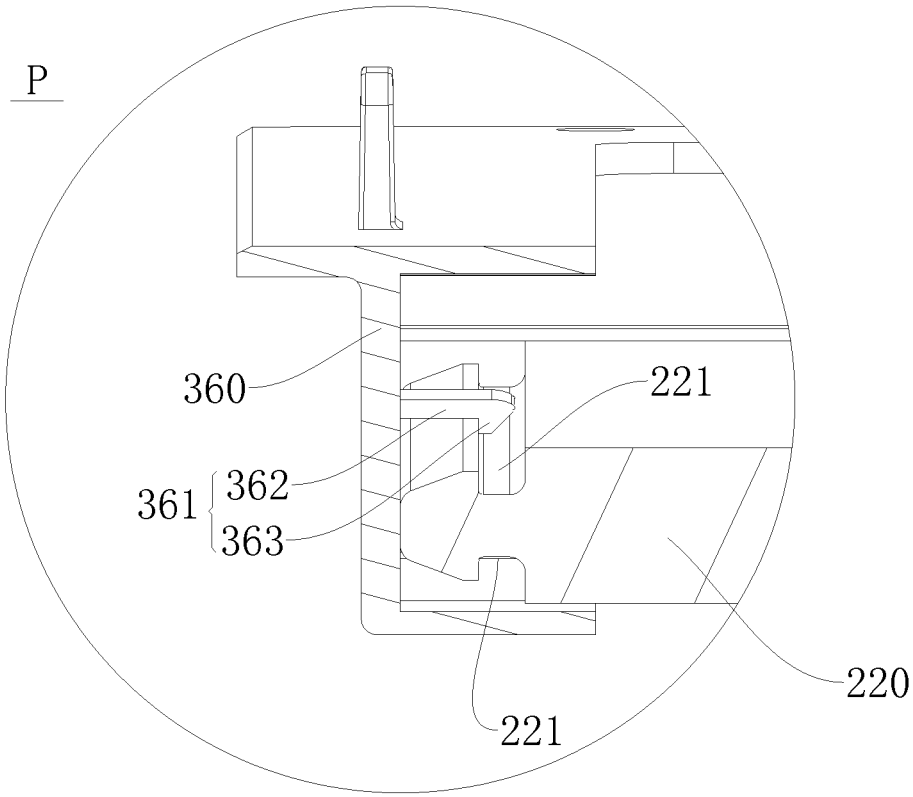
FIG. 29 is a partially enlarged view of portion P in FIG. 26.

As shown in FIG. 3, FIG. 8, FIG. 28 and FIG. 35, the fixed guiding portion 301 includes a first fixed member 310 connected with the air conditioner body 100 and the fixed sealing plate group 210 in a snap-fit manner respectively. Thus, it is convenient for the first fixed member 310 to be connected with the air conditioner body 100 and the fixed sealing plate group 210. For example, as shown in FIG. 3, FIG. 8 and FIG. 28, for the first fixed member 310 located at a left side of the air conditioner body 100, a left side of the first fixed member 310 is connected with the fixed sealing plate group 210 in the snap-fit manner, and a right side of the first fixed member 310 is connected with the air conditioner body 100 in the snap-fit manner.

Figure 35:
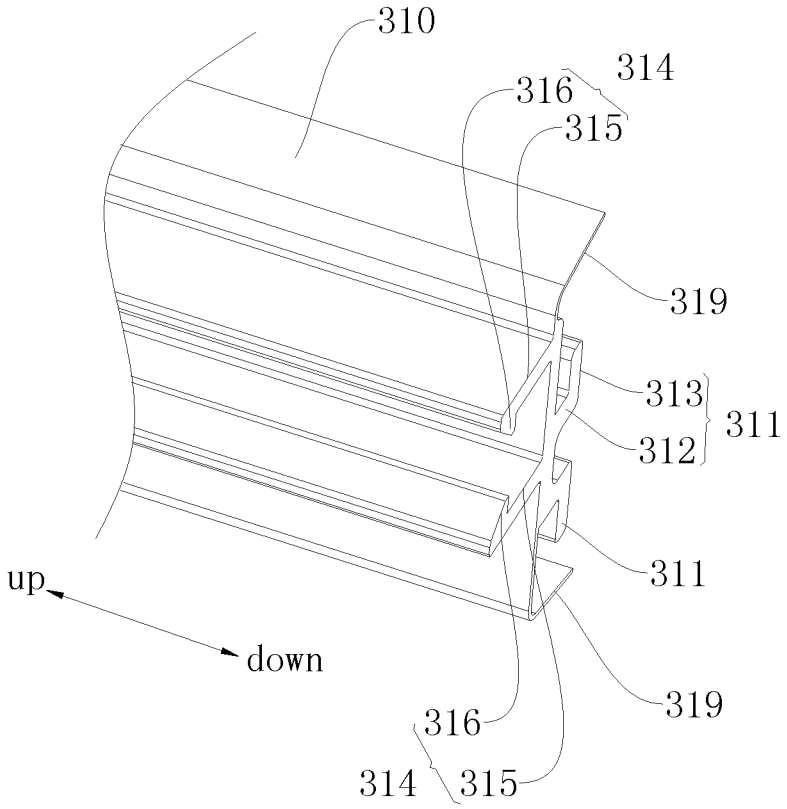
FIG. 35 is a partial schematic view of a first fixed member of a window air conditioner according to an embodiment of the present invention.

In order to improve a connection sealing property between the first fixed member 310 and the air conditioner body 100, as shown in FIG. 3 and FIG. 35, a sealing baffle 319 is provided on a side of the first fixed member 310 facing the air conditioner body 100. Similarly, as shown in FIG. 3, in order to improve a connection sealing property between the first fixed member 310 and the fixed sealing plate group 210, the sealing baffle 319 may also be provided on a side of the first fixed member 310 facing the fixed sealing plate group 210. It should be noted that, the sealing baffle 319 may extend along an up and down direction as shown in FIG. 35. In addition, one or more sealing baffles 319 may be provided.

Further, as shown in FIG. 3, FIG. 8, FIG. 28 and FIG. 35, the first fixed member 310 has a first snap 311 at one side thereof and a second snap 314 at the other side thereof. The first snap 311 is connected with the air conditioner body 100 in the snap-fit manner, and the second snap 314 is connected with the fixed sealing plate group 210 in the snap-fit manner. The air conditioner body 100 has a first snap groove 120 in the side wall thereof, and the first snap groove 120 is matched with the first snap 311. The fixed sealing plate group 210 has a second snap groove 211 in an end portion thereof opposite to the first fixed member 310, and the second snap groove 211 is matched with the second snap 314. It should be noted that, by connecting the first snap 311 on the first fixed member 310 with the first snap groove 120 in the air conditioner body 100 in the snap-fit manner as well as connecting the second snap 314 on the first fixed member 310 with the second snap groove 211 in the fixed sealing plate group 210 in the snap-fit manner, the installation process of the fixed sealing plate group 210 and the air conditioner body 100 is simplified, at the same time the fixed sealing plate group 210 is connected to the air conditioner body 100 firmly and stably in the snap-fit manner.

Figure 11:
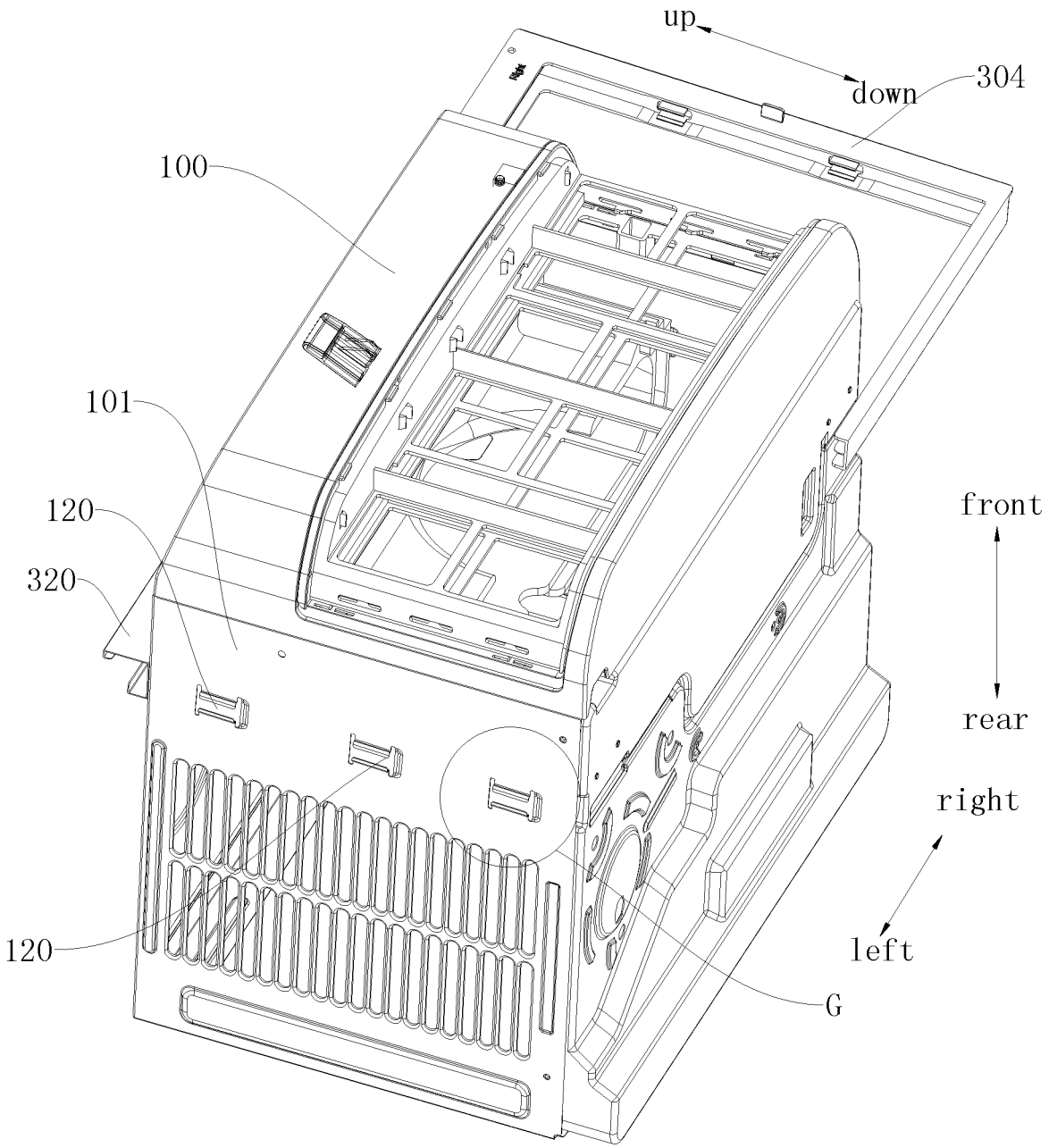
FIG. 11 is a partial schematic view of a window air conditioner according to an embodiment of the present invention.
Figure 12:
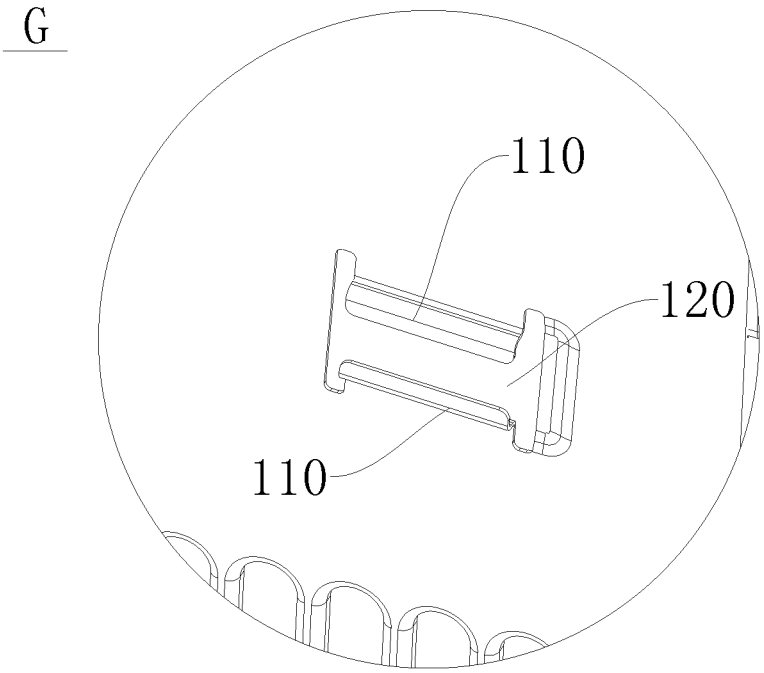
FIG. 12 is a partially enlarged view of portion Gin FIG. 11.
Figure 13:
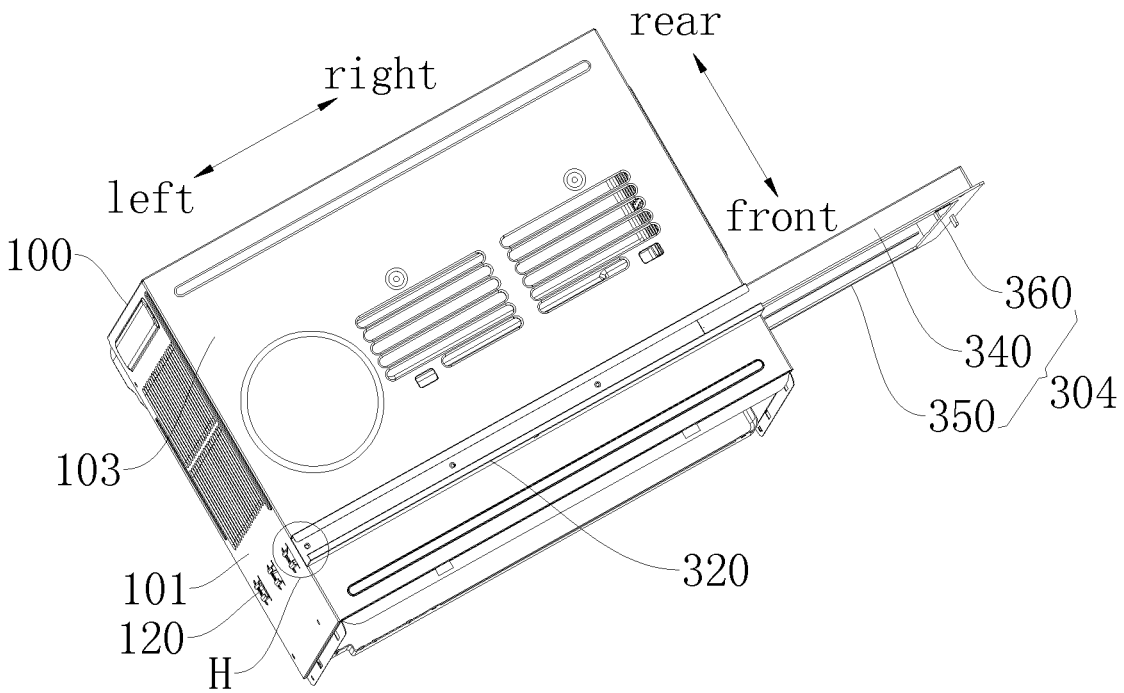
FIG. 13 is a partial schematic view of a window air conditioner according to an embodiment of the present invention.
Figure 14:
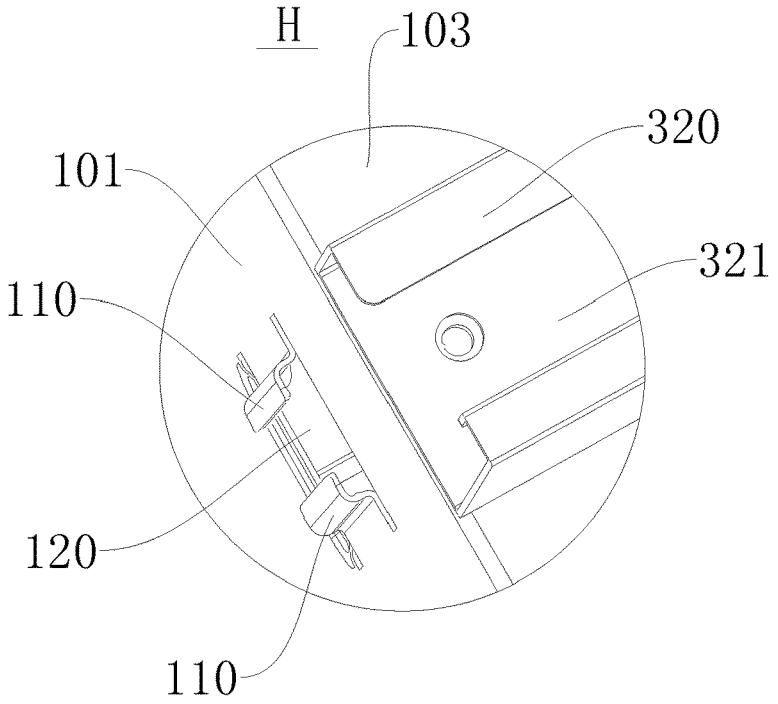
FIG. 14 is a partially enlarged view of portion H in FIG. 13.

As shown in FIG. 11, a plurality of the first snap grooves 120 may be provided and spaced apart from one another along a length direction of the first fixed member 310. Thus, connection stability and reliability of the first fixed member 310 and the air conditioner body 100 can be improved. For example, in an example shown in FIG. 11, three first snap grooves 120 are provided, arranged on the left side wall 101 of the air conditioner body 100, and spaced apart from one another along an up and down direction shown in FIG. 11. In addition, the plurality of the first snap grooves 120 may also be provided on the right side wall 102 of the air conditioner body 100 and spaced apart from one another.

Further, as shown in FIG. 3, FIG. 8, FIG. 28 and FIG. 35, the first snap 311 includes two first extending portions 312 spaced apart from each other and extending out from the side of the first fixed member 310 facing the air conditioner body 100, and each first extending portion 312 has a first snapping member 313 at a free end thereof and two first snapping members 313 extend away from each other. As shown in FIG. 3, FIG. 8, FIG. 11 to FIG. 14 and FIG. 28, the air conditioner body 100 has two side wings 110 on the side wall thereof, the two side wings 110 are spaced apart from each other and configured to form the first snap groove 120, and each side wing 110 is configured to have a substantial L shape. For example, as shown in FIG. 11 to FIG. 14, the air conditioner body 100 has three first snap grooves 120 on the left side wall 101 thereof, the three first snap grooves 120 are spaced apart from each other, each of the first snap grooves 120 is formed by two opposite side wings 110, and each side wing 110 is configured to have a substantial L shape. In the assembly process of the first fixed member 310 and the air conditioner body 100, the first snap 311 of the first fixed member 310 may be inserted into the first snap groove 120 along the up and down direction in FIG. 11. Thus, an installation process of the first fixed member 310 is simplified.

Figure 26:
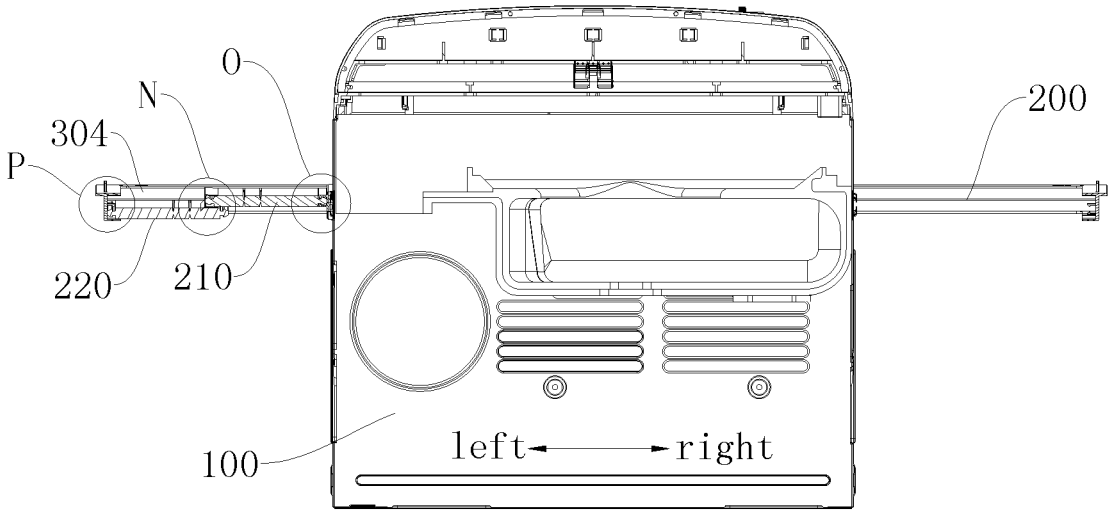
FIG. 26 is a section view of a window air conditioner according to an embodiment of the present invention.
Figure 34:
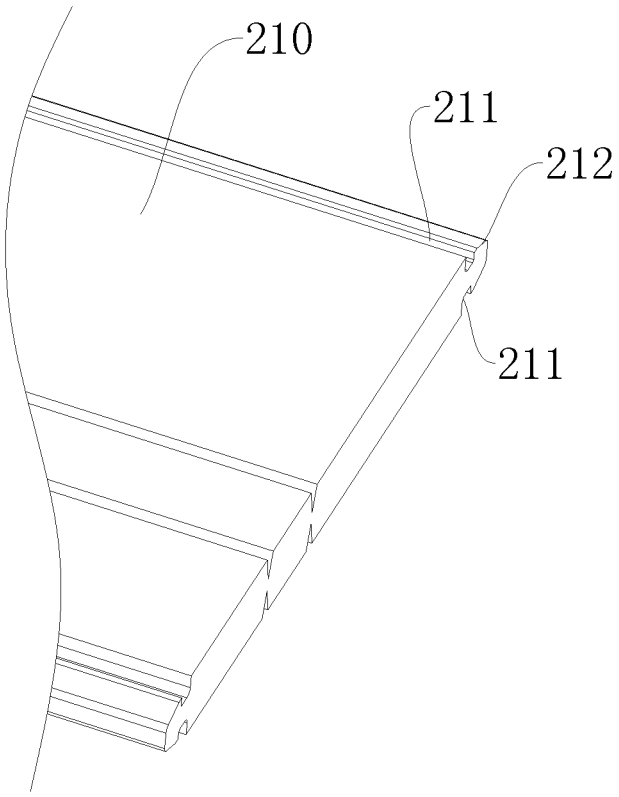
FIG. 34 is a partial schematic view of a fixed sealing plate group of a window air conditioner according to an embodiment of the present invention.

In some embodiments of the present invention, as shown in FIG. 26, FIG. 28 and FIG. 34, two second snap grooves 211 are provided and formed in two opposite side walls of the fixed sealing plate group 210 respectively. As shown in FIG. 28 and FIG. 35, the second snap 314 includes two second extending portions 315 spaced apart from each other and extending out from the first fixed member 310, each of the two second extending portions 315 has a second snapping member 316 at a free end thereof, and the second snapping members 316 are protruded towards each other and matched with the second snap grooves 211. Thus, connection reliability and sealing property of the first fixed member 310 and the fixed sealing plate group 210 can be improved. Further, in order to improve assembling convenience of the first fixed member 310 and the fixed sealing plate group 210, as shown in FIG. 28 and FIG. 34, the fixed sealing plate group 210 has an inclined surface 212 between an end surface of the fixed sealing plate group 210 facing the first fixed member 310 and the second snap groove 211.

In some other embodiments of the present invention, as shown in FIG. 3, FIG. 8, FIG. 15 and FIG. 18, the second snap groove 211 is formed in an end surface of the fixed sealing plate group 210 opposite to the first fixed member 310, and the second snap 314 is configured to be a first protrusion 317 protruded towards the fixed sealing plate group 210 and matched with the second snap groove 211. Thus, connection reliability and sealing property of the first fixed member 310 and the fixed sealing plate group 210 can be improved. As shown in FIG. 8, in a direction from a fixed end of the first protrusion 317 to a free end of the first protrusion 317, opposite side walls of the first protrusion 317 fitted with the second snap groove 211 are inclined towards each other gradually. Thus, it is convenient for the first protrusion 317 to be fitted with the second snap groove 211. Furthermore, a first snapping projection 318 is formed on the side wall of the first protrusion 317 fitted with the second snap groove 211, and a first concave portion 213 fitted with the first snapping projection 318 is provided in a position in the second snap groove 211 opposed to the first snapping projection 318, such that the first protrusion 317 can be prevented from falling off from the second snap groove 211, thus improving the connection reliability and stability of the fixed sealing plate group 210 and the first fixed member 310, and at the same time improving the connection sealing property of the fixed sealing plate group 210 and the first fixed member 310.

According to an embodiment of the present invention, as shown in FIG. 19 and FIG. 20, the fixed guiding portion 301 further includes a second fixed member 320 disposed on a top wall and/or a bottom wall of the air conditioner body 100, and the sliding guiding portion 304 is slidably disposed on the second fixed member 320, which is convenient for the sliding guiding portion 304 to slide along a preset sliding trace, thus improving a sliding stability of the sliding guiding portion 304. It should be understood that, one second fixed member 320 may be provided and disposed on the top wall 103 or the bottom wall of the air conditioner body 100, or two second fixed members 320 may also be provided and disposed on the top wall 103 and the bottom wall of the air conditioner body 100 respectively.

In some embodiments of the present invention, one of the second fixed member 320 and the sliding guiding portion 304 may have a guiding groove 321 extending along a sliding direction of the sliding guiding portion 304, and the other thereof has a guiding sliding track 305 matched with the guiding groove 321. Thus, the fitting stability between the second fixed member 320 and the sliding guiding portion 304 can be improved, and the sliding guiding portion 304 can slide along the preset trace. For example, as shown in FIG. 19 and FIG. 20, the second fixed member 320 has the guiding groove 321 therein, the sliding guiding portion 304 has the guiding sliding track 305 matched with the guiding groove 321, and the guiding sliding track 305 can move along the guiding groove 321, so as to drive the sliding guiding portion 304 and the sliding sealing plate group 220 to move, which is convenient for adjusting the sealing plate assembly 200 and for the window air conditioner 1000 to be suitable for different installation conditions.

Figure 31:
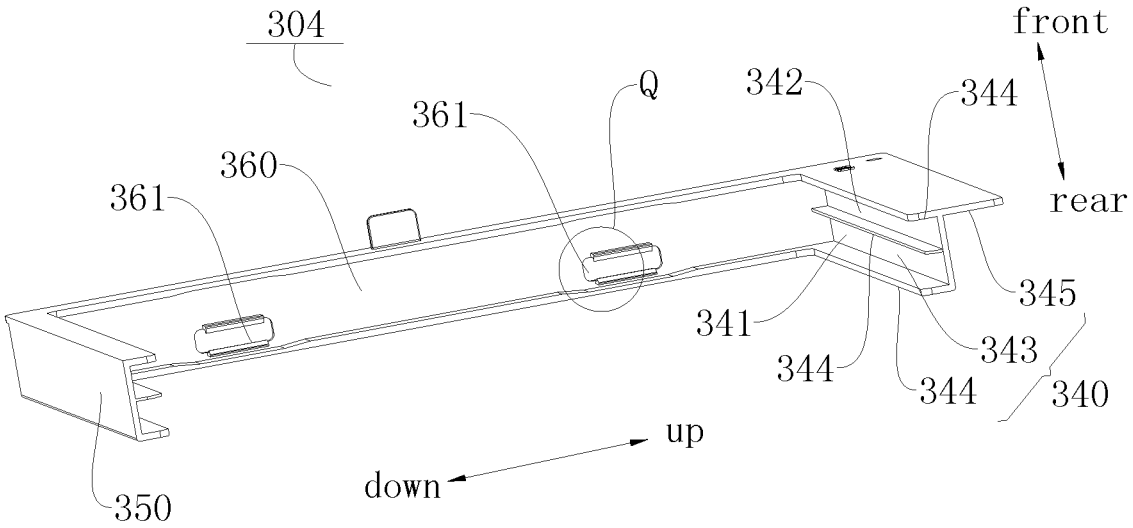
FIG. 31 is a perspective view of a sliding guiding portion of a window air conditioner according to an embodiment of the present invention.
Figure 32:
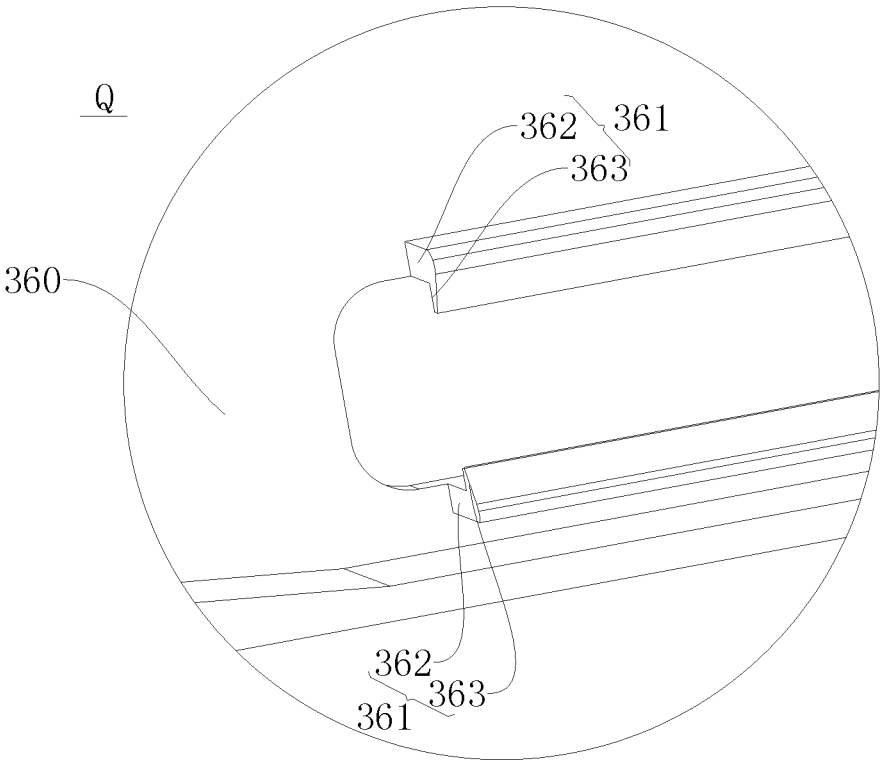
FIG. 32 is a partially enlarged view of portion Q in FIG. 31.

As shown in FIG. 30 to FIG. 32, according to one embodiment of the present invention, the sliding guiding portion 304 includes a first support plate 340 slidably fitted with the fixed guiding portion 301, and the first support plate 340 has a first sliding groove 341 and a second sliding groove 342 disposed side by side along a front and rear direction (the front and rear direction shown in FIG. 31); the fixed sealing plate group 210 is slidably fitted within the first sliding groove 341 and the sliding sealing plate group 220 is fixed within the second sliding groove 342. Thus, the sliding sealing plate group 220 can move with respect to the fixed sealing plate group 210 along the preset trace.

According to one embodiment of the present invention, as shown in FIG. 19 to FIG. 20, FIG. 24 to FIG. 25 and FIG. 31, the first support plate 340 includes a main plate 343, a guiding plate 345 disposed at one side of the main plate 343 and slidably fitted with the fixed guiding portion 301, and a plurality of side plates 344 disposed at the other side of the main plate 343 and configured to define the first sliding groove 341 and the second sliding groove 342. For example, as shown in FIG. 19 to FIG. 20 and FIG. 24 to FIG. 25, the guiding plate 345 is slidably fitted within the guiding groove 321 of the second fixed member 320, a part of the first support plate 340 fitted with the guiding groove 321 is configured as the guiding sliding track 305, and with the guiding of the guiding groove 321, the first support plate 340 can slide along the guiding groove 321, thus driving the sliding sealing plate group 220 to slide. As shown in FIG. 31, in order to improve a structural strength of the first support plate 340, the guiding plate 345 is flush with one of the plurality of side plates 344.

Further, the sliding guiding portion 304 may further include a connecting plate 360 and a second support plate 350. The second support plate 350 is parallel to the first support plate 340 and spaced apart from the first support plate 340 in the up and down direction. The second support plate 350 is slidably fitted with the fixed guiding portion 301, the connecting plate 360 is connected between the first support plate 340 and the second support plate 350, and the sliding sealing plate group 220 is connected with the connecting plate 360 in the snap-fit manner. Thus, a structural stability of the sliding guiding portion 304 is improved and the sliding sealing plate group 220 can slide along the preset trace.

According to some embodiments of the present invention, as shown in FIG. 5, FIG. 15 to FIG. 16, FIG. 26, FIG. 29 and FIG. 30 to FIG. 32, the connecting plate 360 may have a third snap 361, and the sliding sealing plate group 220 has a third snap groove 221 in an end portion thereof opposite to the connecting plate 360, the third snap groove 221 is matched with the third snap 361, which is convenient for the sliding sealing plate group 220 to be installed to the connecting plate 360.

In an embodiment of the present invention, as shown in FIG. 26, FIG. 29 and FIG. 30 to FIG. 32, two third snap grooves 221 are provided and formed in two opposite side walls of the sliding sealing plate group 220 respectively, the third snap 361 includes two third extending portions 362 spaced apart from each other and extending out from the connecting plate 360 towards the sliding sealing plate group 220, each of the two third extending portions 362 has a third snapping member 363 at a free end thereof, and the third snapping members 363 are protruded towards each other and matched with the third snap grooves 221. Thus, the sliding sealing plate group 220 is connected to the connecting plate 360 firmly and stably in the snap-fit manner. Further, as shown in FIG. 31, a plurality of the third snaps 361 are provided and spaced apart from one another along a length direction (the up and down direction shown in FIG. 31) of the connecting plate 360. Thus, connection reliability and stability of the sliding sealing plate group 220 and the connecting plate 360 can be improved.

Figure 5:
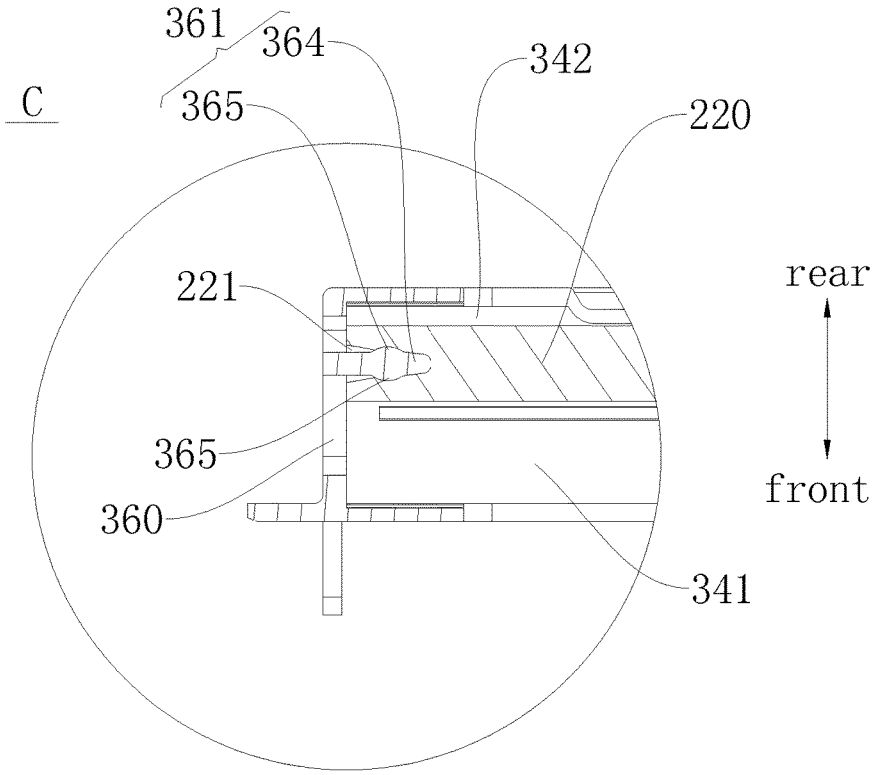
FIG. 5 is a partially enlarged view of portion C in FIG. 4.
Figure 15:
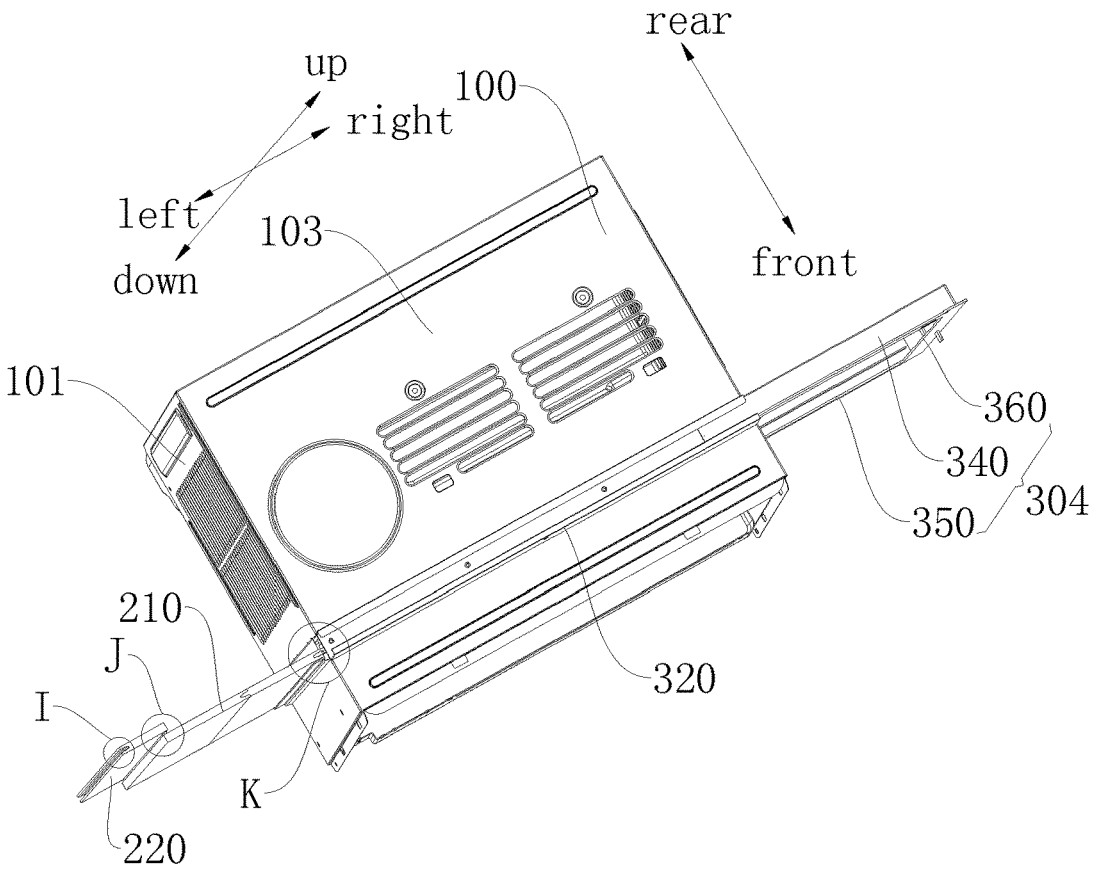
FIG. 15 is a partial schematic view of a window air conditioner according to an embodiment of the present invention.
Figure 16:
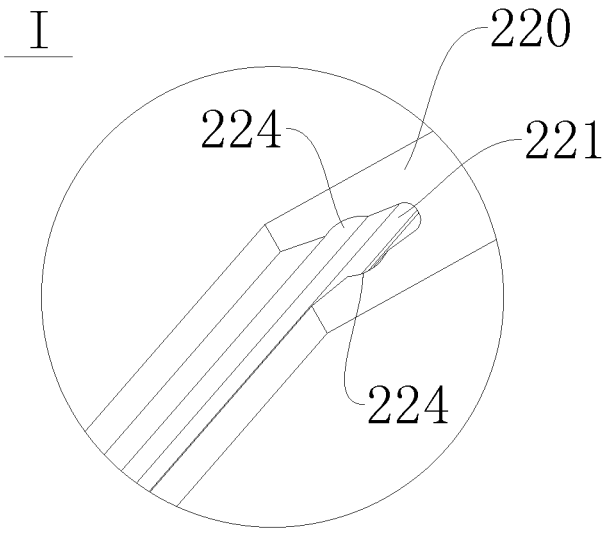
FIG. 16 is a partially enlarged view of portion I in FIG. 15.
Figure 17:
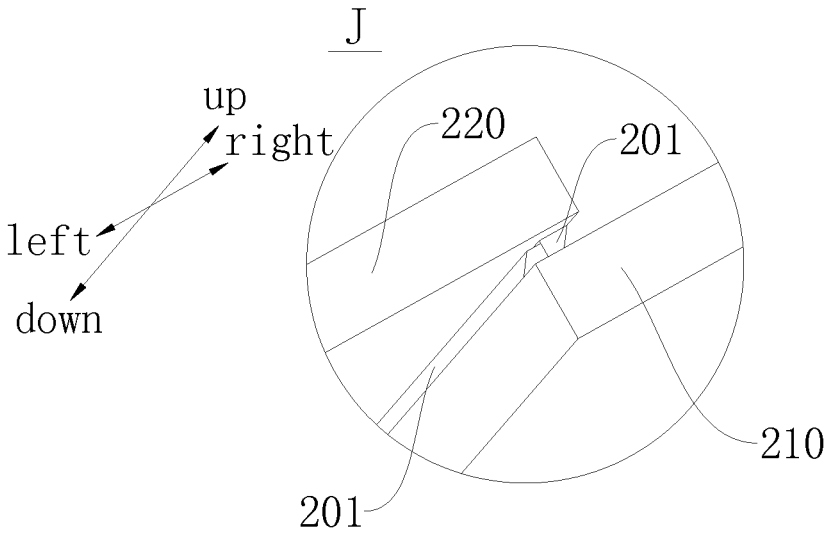
FIG. 17 is a partially enlarged view of portion J in FIG. 15.
Figure 18:
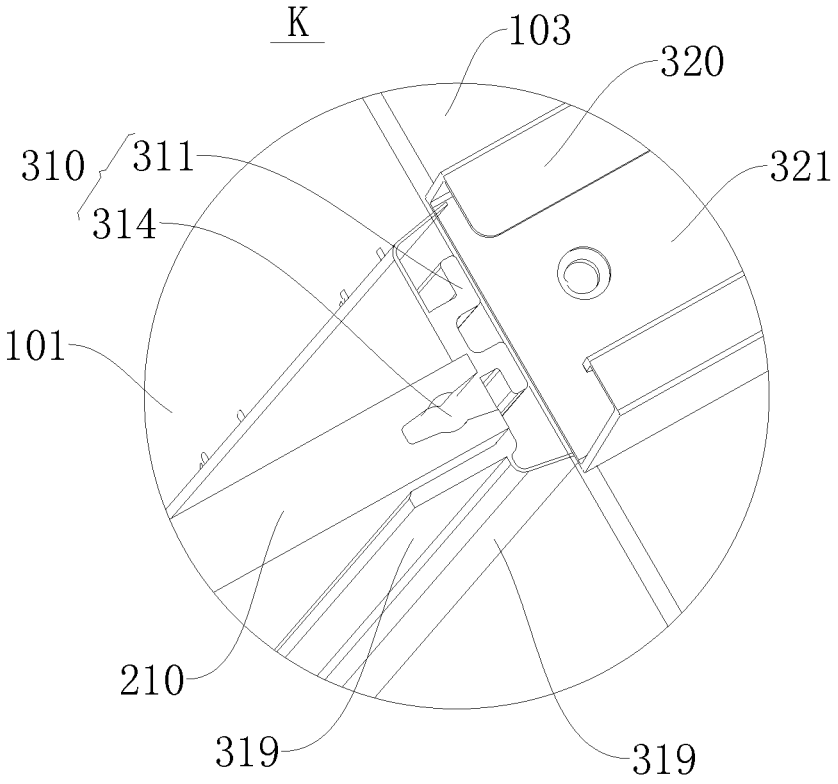
FIG. 18 is a partially enlarged view of portion K in FIG. 15.

In another embodiment of the present invention, as shown in FIG. 5 and FIG. 15 to FIG. 16, one third snap groove 221 is provided and formed in an end surface of the sliding sealing plate group 220 opposite to the connecting plate 360, the third snap 361 is configured to be a second protrusion 364 protruded towards the sliding sealing plate group 220 and matched with the third snap groove 221. Thus, the connection reliability, stability and sealing property of the sliding sealing plate group 220 and the connecting plate 360 can be improved. Further, as shown in FIG. 5, in a direction from a fixed end of the second protrusion 364 to a free end of the second protrusion 364, opposite side walls of the second protrusion 364 fitted with the third snap groove 221 are inclined towards each other gradually. Furthermore, as shown in FIG. 5 and FIG. 15 to FIG. 16, a second snapping projection 365 is formed on the side wall of the second protrusion 364 fitted with the third snap groove 221, and a second concave portion 224 fitted with the second snapping projection 365 is provided in a position in the third snap groove 221 opposed to the second snapping projection 365, such that the second protrusion 364 can be prevented from falling off from the third snap groove 211 accidentally, thus improving the connection reliability and stability of the sliding sealing plate group 220 and the connecting plate 360.

According to an embodiment of the present invention, the sliding sealing plate group 220 may include a plurality of sub sliding sealing plates, and two adjacent sub sliding sealing plates are connected with each other in the sealing manner. Thus, it is convenient for the sealing plate assembly 200 to be suitable for different installation conditions, and the sealing connection between the two adjacent sub sliding sealing plates can also improve a sealing property of the sealing plate assembly 200 and reduce the heat exchange efficiency between the indoor environment and the outdoor environment.

In an embodiment of the present invention, the sub sliding sealing plate is configured as a PVC heat insulation plate, which thus can meet a requirement of heat insulation R1 value and provide a great sealing property and appearance. For example, in related art, Energy Star product has a requirement for an installation accessory (such as a sealing shutter) of the window air conditioner that the R1 value should be satisfied. In the embodiment of the present invention, the installation accessory (such as the sealing plate assembly in the embodiments of the present invention) of the window air conditioner can meet the R1 value requirement by using the PVC heat insulation plate.

Figure 6:
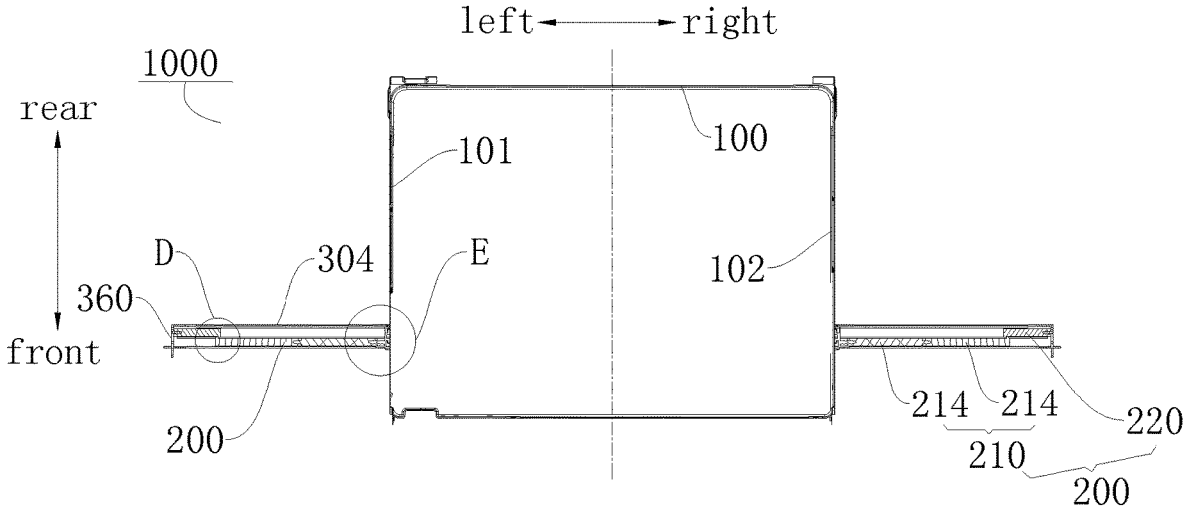
FIG. 6 is a partially exploded schematic view of a window air conditioner according to an embodiment of the present invention.

According to an embodiment of the present invention, the fixed sealing plate group 210 may include a plurality of sub fixed sealing plates 214 and two adjacent sub fixed sealing plates 214 are connected with each other in the sealing manner, so that it is convenient for the sealing plate assembly 200 to be suitable for different installation conditions, and the sealing connection between the two adjacent sub fixed sealing plates can also improve a sealing property of the sealing plate assembly 200 and reduce the heat exchange efficiency between the indoor environment and the outdoor environment. For example, as shown in FIG. 6 and FIG. 9, the fixed sealing plate group 210 includes two sub fixed sealing plates 214 and the two adjacent sub fixed sealing plates 214 are connected with each other in the sealing manner.

Figure 9:
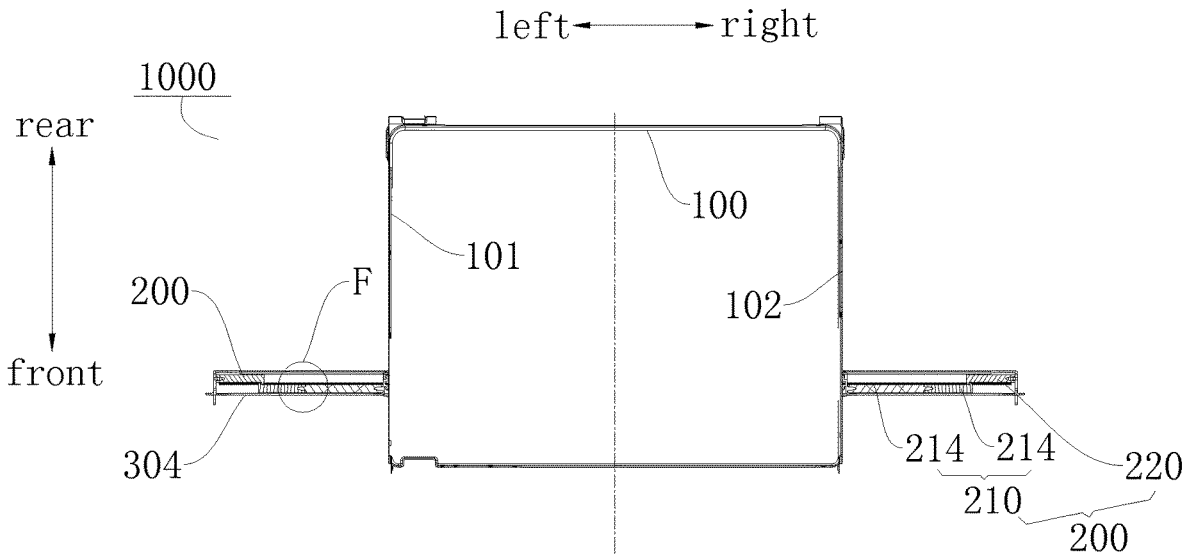
FIG. 9 is a schematic view of a window air conditioner according to an embodiment of the present invention.
Figure 10:
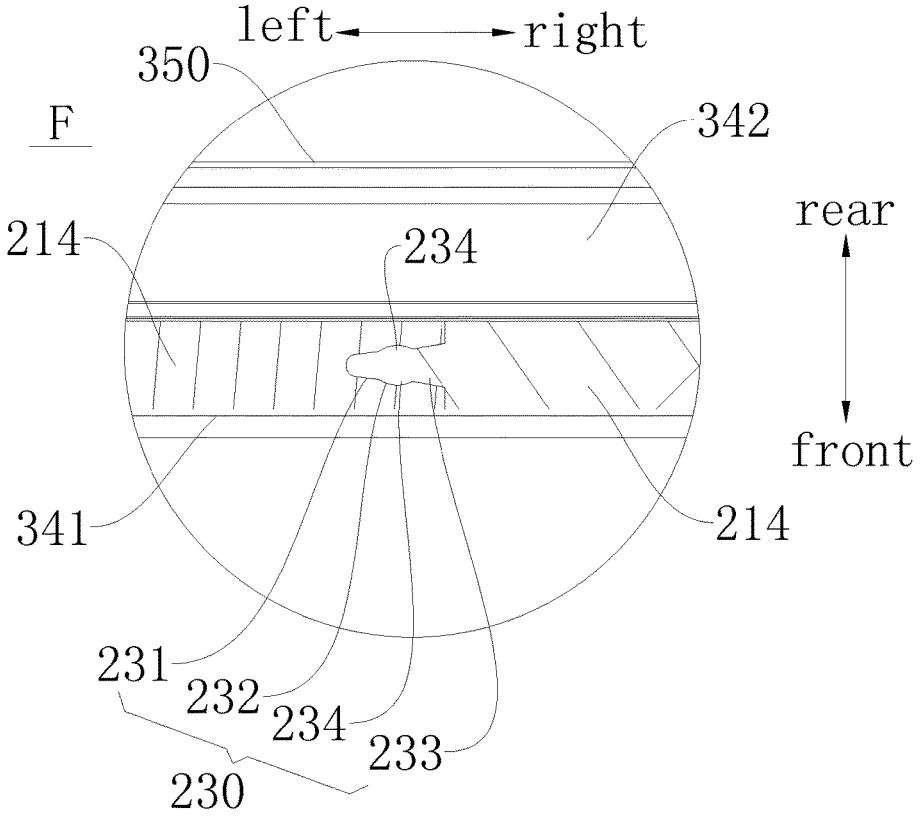
FIG. 10 is a partially enlarged view of portion F in FIG. 9.

As shown in FIG. 9 to FIG. 10, in an embodiment of the present invention, two adjacent sub fixed sealing plates 214 are connected with each other through a snap-fit assembly 230, and the snap-fit assembly includes a snapping groove 231 disposed in one of the two adjacent sub fixed sealing plates 214 and a third protrusion 233 matched with the snapping groove 231 and disposed on the other of the two adjacent sub fixed sealing plates 214. Thus, the installation process of the two adjacent sub fixed sealing plates 214 is simplified, and also, it is convenient for the sealing connection between the two adjacent sub fixed sealing plates 214. For example, in an example shown in FIG. 9 to FIG. 10, the snapping groove 231 is provided in the sub fixed sealing plates 214 located at a left side, and the third protrusion 233 is disposed on the sub fixed sealing plates 214 located at a right side. Due to a fitting between the third protrusion 233 and the snapping groove 231, the installation process of the two adjacent sub fixed sealing plates 214 is simplified, and the connection sealing property between the two adjacent sub fixed sealing plates 214 is also improved.

In an embodiment of the present invention, the sub fixed sealing plate 214 is configured as the PVC heat insulation plate. Thus, the R1 value requirement for heat insulation can be satisfied, and the great sealing property and appearance can be provided. For example, in related art, the Energy Star product has the requirement for the installation accessory (such as the sealing shutter) of the window air conditioner that the R1 value requirement should be satisfied. In the embodiment of the present invention, the installation accessory (such as the sealing plate assembly in the embodiments of the present invention) of the window air conditioner can meet the R1 value requirement by using the PVC heat insulation plate.

Further, as shown in FIG. 10, in a direction from a fixed end of the third protrusion 233 to a free end of the third protrusion 233, opposite side walls of the third protrusion 233 fitted with the snapping groove 231 are inclined towards each other gradually, which is convenient for the two sub fixed sealing plates 214 to be connected with each other in the sealing and snap-fit manner. Furthermore, a third snapping projection 234 is formed on the side wall of the third protrusion 233 fitted with the snapping groove 231, and a third concave portion 232 fitted with the third snapping projection 234 is provided in a position in the snapping groove 231 opposed to the third snapping projection 234, such that the third protrusion 233 can be prevented from falling off from the snapping groove 231, thus improving the connection reliability, stability and sealing property of the two adjacent sub fixed sealing plates 214.

It should be noted that, the two adjacent sub fixed sealing plates 214 may also be connected with each other in the sealing and snap-fit manner through the snap-fit assembly 230.

According to some embodiments of the present invention, as shown in FIG. 1 to FIG. 6, two sealing plate assemblies 200 may be distributed at two sides of the air conditioner body 100 symmetrically. Thus, a structural stability of the window air conditioner 1000 can be improved.

According to some embodiments of the present invention, as shown in FIG. 2, FIG. 7, FIG. 27, FIG. 30 and FIG. 33, in order to improve a structural sealing property of the sealing plate assembly 200, a sealing assembly 204 is provided between the sliding sealing plate group 220 and the fixed sealing plate group 210.

Figure 2:
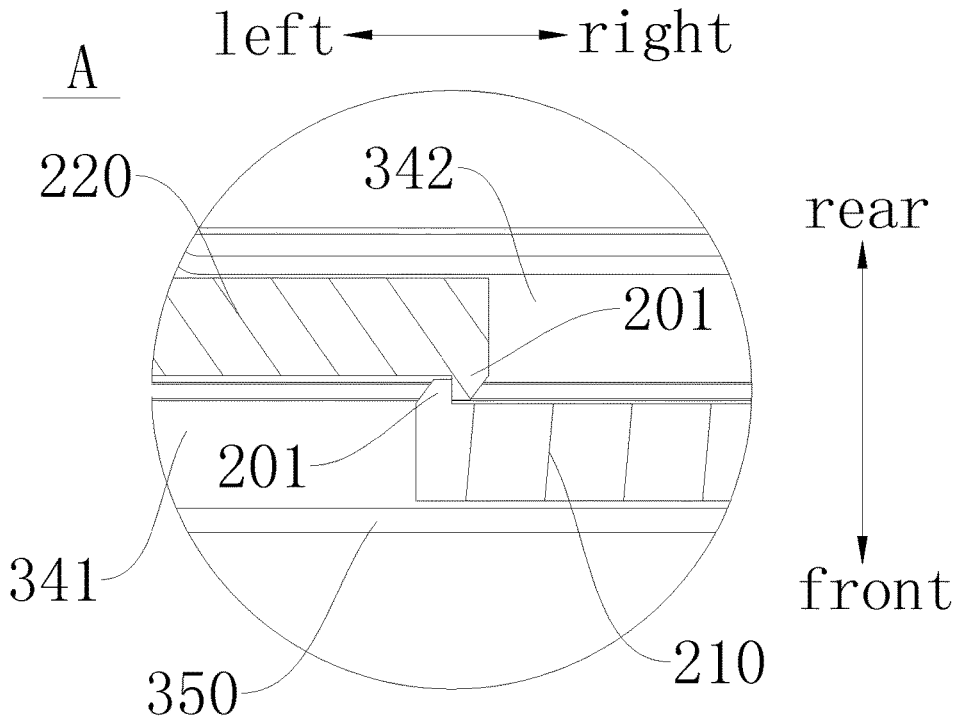
FIG. 2 is a partially enlarged view of portion A in FIG. 1.
Figure 7:
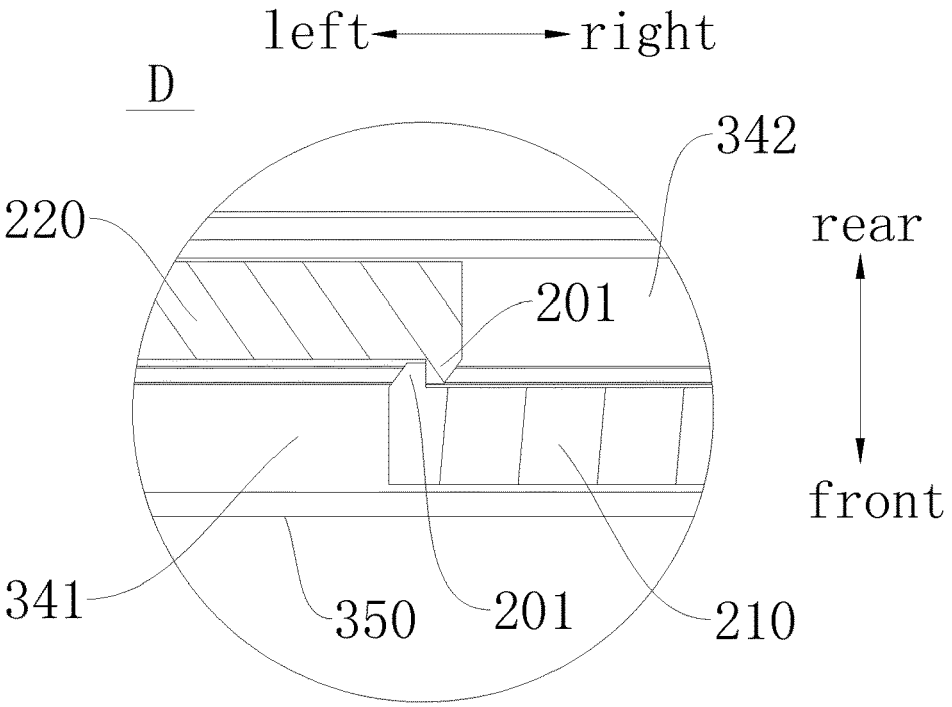
FIG. 7 is a partially enlarged view of portion D in FIG. 6.

In some example embodiments of the present invention, the sealing assembly 204 may include a sealing protruded strip 201 extending along a length direction of the sliding sealing plate group 220 (the up and down direction shown in FIG. 15 and FIG. 17) and disposed on at least one of the sliding sealing plate group 220 and the fixed sealing plate group 210, and a free end of the sealing protruded strip 201 touches with the corresponding fixed sealing plate group 210 or sliding sealing plate group 220. For example, as shown in FIG. 2 and FIG. 7, each of the sliding sealing plate group 220 and the fixed sealing plate group 210 is provided with the sealing protruded strip 201, the free end of the sealing protruded strip 201 located on the sliding sealing plate group 220 touches with the fixed sealing plate group 210, and the free end of the sealing protruded strip 201 located on the fixed sealing plate group 210 touches with the sliding sealing plate group 220, thus the connection sealing property between the sliding sealing plate group 220 and the fixed sealing plate group 210 can be improved.

In an example of the present invention, the sealing protruded strip 201 located on the sliding sealing plate group 220 may be disposed at an end portion of the sliding sealing plate group 220 close to the air conditioner body 100, and the sealing protruded strip 201 located on the fixed sealing plate group 210 may be disposed at an end portion of the fixed sealing plate group 210 away from the air conditioner body 100.

Figure 27:
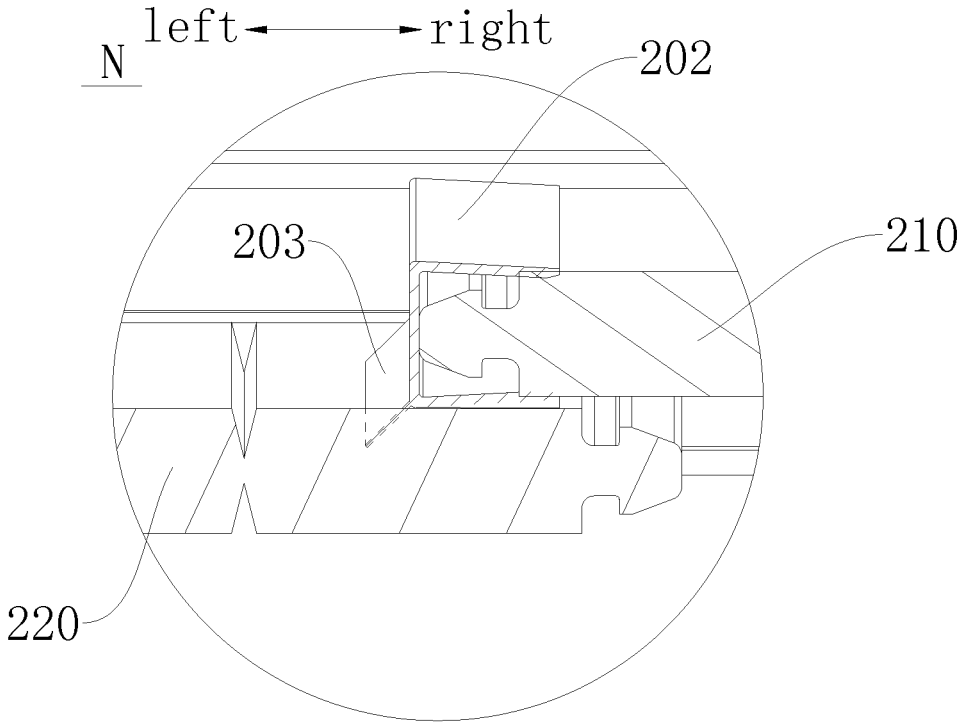
FIG. 27 is a partially enlarged view of portion N in FIG. 26.
Figure 33:
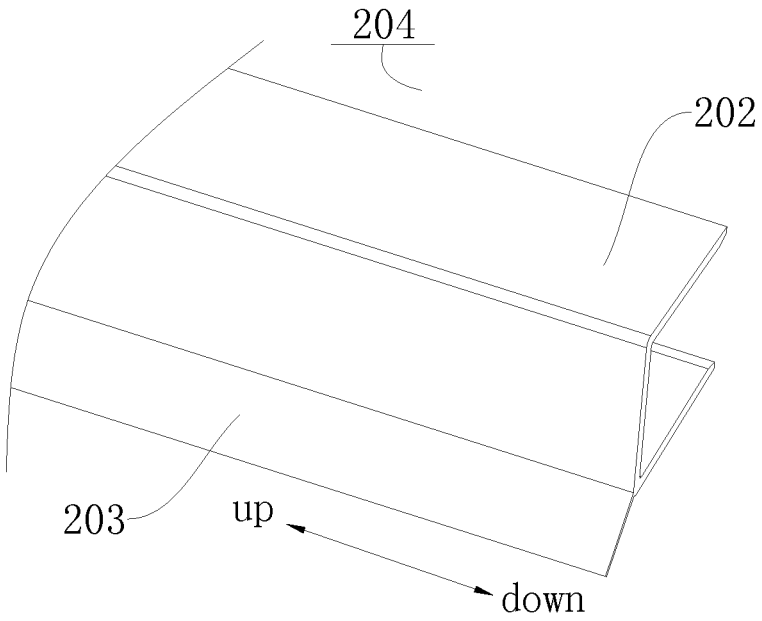
FIG. 33 is a partial schematic view of a sealing assembly of a window air conditioner according to an embodiment of the present invention.

In some other examples of the present invention, as shown in FIG. 27, FIG. 30 and FIG. 33, the sealing assembly 204 is configured to be a sealing strip 202 clamped between the sliding sealing plate group 220 and the fixed sealing plate group 210. The sealing strip 202 may include a U-shaped sealing groove, and the U-shaped sealing groove covers an end portion of the fixed sealing plate group 210 toward the sliding sealing plate group 220 or an end portion of the sliding sealing plate group toward the fixed sealing plate group. For example, one U-shaped sealing groove may be provided and cover the end portion of the fixed sealing plate group 210 facing the sliding sealing plate group 220 or the end portion of the sliding sealing plate group 220 facing the fixed sealing plate group 210. Certainly, two U-shaped sealing grooves may also be provided and cover the end portion of the fixed sealing plate group 210 facing the sliding sealing plate group 220 and the end portion of the sliding sealing plate group 220 facing the fixed sealing plate group 210 respectively.

Further, as shown in FIG. 27 and FIG. 33, the sealing strip 202 further includes a sealing edge strip 203 extending along a length direction of the U-shaped sealing groove (the up and down direction shown in FIG. 33), and one end of the sealing edge strip 203 is connected with the U-shaped sealing groove and the other end thereof touches with the sliding sealing plate group 220 or the fixed sealing plate group 210. For example, as shown in FIG. 27, the U-shaped sealing groove of the sealing strip 202 covers the end portion of the fixed sealing plate group 210 close to the sliding sealing plate group 220, one end of the sealing edge strip 203 is connected with the U-shaped sealing groove and the other end thereof touches with the sliding sealing plate group 220.

In the following, a window air conditioner 1000 according to embodiments of the present invention will be described in detail through specific embodiments with reference to FIG. 24 to FIG. 35. It should be understood that, descriptions below are only exemplary, and cannot be construed to limit the present invention.

As shown in FIG. 24 to FIG. 35, the window air conditioner 1000 includes an air conditioner body 100, a sealing plate assembly 200 and a guiding assembly 300, in which two sets of the sealing plate assembly 200 are provided and disposed on a left side wall 101 and a right side wall 102 of the air conditioner body 100 symmetrically. The sealing plate assembly 200 is connected with the air conditioner body 100 through the guiding assembly 300. The guiding assembly 300 may include a fixed guiding portion 301 and a sliding guiding portion 304, and the fixed guiding portion 301 includes a first fixed member 310 and a second fixed member 320. The sealing plate assembly 200 includes a fixed sealing plate group 210 and a sliding sealing plate group 220. Two first fixed members 310 are provided and located at the left side wall 101 and the right side wall 102 of the air conditioner body 100. The fixed sealing plate group 210 is connected with the air conditioner body 100 through the first fixed member 310, the sliding guiding portion 304 is connected with the sliding sealing plate group 220 in a snap-fit manner, and the sliding guiding portion 304 and the sliding sealing plate group 220 are slidable with respect to the fixed sealing plate group 210. Thus, with the sliding guiding portion 304 and the sliding sealing plate group 220 slidably fitted with the fixed sealing plate group 210, the window air conditioner 1000 can be suitable for different installation conditions. The second fixed member 320 is disposed on a top wall 103 of the air conditioner body 100, and the sliding guiding portion 304 is slidably fitted with the second fixed member 320.

In the following, the window air conditioner 1000 according to the embodiments of the present invention will be described in detail by taking the sealing plate assembly 200 and the guiding assembly 300 located at the left side of the air conditioner body 100 as an example. The sealing plate assembly 200 and the guiding assembly 300 located at the right side of the air conditioner body 100 have same structures as the sealing plate assembly 200 and the guiding assembly 300 located at the left side of the air conditioner body 100 and will not be described here.

In particular, as shown in FIG. 28 and FIG. 35, the first fixed member 310 has a first snap 311 at a right side thereof, and the first snap 311 is connected with the air conditioner body 100 in the snap-fit manner. The air conditioner body 100 has a first snap groove 120 in the left side wall 101 thereof, and the first snap groove 120 is matched with the first snap 311. The first snap 311 includes two first extending portions 312 spaced apart from each other and extending out from a side of the first fixed member 310 facing the air conditioner body 100, and each first extending portion 312 has a first snapping member 313 at a free end thereof and two first snapping members 313 extend away from each other. Three first snap grooves 120 are provided and spaced apart from each other, each of the first snap grooves 120 is formed by two opposite side wings 110, and each side wing 110 is configured to have a substantial L shape. In the assembly process of the first fixed member 310 and the air conditioner body 100, the first snap 311 of the first fixed member 310 may be inserted into the first snap groove 120 along an up and down direction in FIG. 30.

As shown in FIG. 28 and FIG. 35, the first fixed member 310 has a second snap 314 at a left side thereof, and the second snap 314 is connected with the fixed sealing plate group 210 in the snap-fit manner. The fixed sealing plate group 210 has a second snap groove 211 in an end portion thereof opposite to the first fixed member 310, and the second snap groove 211 is matched with the second snap 314. Two second snap grooves 211 are provided and formed in two opposite side walls of the fixed sealing plate group 210 respectively. The second snap 314 includes two second extending portions 315 spaced apart from each other and extending out from the first fixed member 310, each of the two second extending portions 315 has a second snapping member 316 at a free end thereof, and the second snapping members 316 are protruded towards each other and matched with the second snap grooves 211. Thus, connection reliability and sealing property of the first fixed member 310 and the fixed sealing plate group 210 can be improved. Further, in order to improve assembling convenience of the first fixed member 310 and the fixed sealing plate group 210, the fixed sealing plate group 210 has an inclined surface 212 between an end surface of the fixed sealing plate group 210 facing the first fixed member 310 and the second snap groove 211.

The second fixed member 320 has a guiding groove 321, the sliding guiding portion 304 has a guiding sliding track 305 matched with the guiding groove 321, and the guiding sliding track 305 can move along the guiding groove 321, so as to drive the sliding guiding portion 304 and the sliding sealing plate group 220 to move, which is convenient for adjusting the sealing plate assembly 200 and for the window air conditioner 1000 to be suitable for different installation environments.

The sliding guiding portion 304 may include a first support plate 340, a second support plate 350 and a connecting plate 360 connected between the first support plate 340 and the second support plate 350. The first support plate 340 and the second support plate 350 are parallel with each other, and the first support plate 340 and the second support plate 350 each may be provided with a first sliding groove 341 and a second sliding groove 342 disposed side by side along a front and rear direction. The fixed sealing plate group 210 is slidably fitted within the first sliding groove 341 and the sliding sealing plate group 220 is fixed within the second sliding groove 342. Thus, the sliding sealing plate group 220 can move with respect to the fixed sealing plate group 210 along a preset trace.

The first support plate 340 may include a main plate 343, a guiding plate 345 and a plurality of side plates 344. The guiding plate 345 is disposed at one side of the main plate 343 and slidably fitted with the fixed guiding portion 301. The plurality of side plates 344 is disposed at the other side of the main plate 343 and configured to define the first sliding groove 341 and the second sliding groove 342. The guiding plate 345 is slidably fitted within the guiding groove 321 of the second fixed member 320, a part of the first support plate 340 fitted with the guiding groove 321 is configured as the guiding sliding track 305. With the guiding of the guiding groove 321, the first support plate 340 can slide along the guiding groove 321, thus driving the sliding sealing plate group 220 to slide. As shown in FIG. 31, in order to improve a structural strength of the first support plate 340, the guiding plate 345 is flush with one of the plurality of side plates 344.

The connecting plate 360 may have a third snap 361, the sliding sealing plate group 220 has a third snap groove 221 in an end portion thereof opposite to the connecting plate 360, and the third snap groove 221 is matched with the third snap 361, so that it is convenient for the sliding sealing plate group 220 to be installed to the connecting plate 360. Two third snap grooves 221 may be provided and formed in two opposite side walls of the sliding sealing plate group 220 respectively. The third snap 361 may include two third extending portions 362 spaced apart from each other and extending out from the connecting plate 360 towards the sliding sealing plate group 220, each of the two third extending portions 362 has a third snapping member 363 at a free end thereof, and the third snapping members 363 are protruded towards each other and matched with the third snap grooves 221. Thus, the sliding sealing plate group 220 is connected to the connecting plate 360 firmly and stably in the snap-fit manner. Further, as shown in FIG. 31, a plurality of the third snaps 361 is provided and spaced apart from one another along a length direction of the connecting plate 360. Thus, connection reliability and stability of the sliding sealing plate group 220 and the connecting plate 360 can be improved.

The sealing plate assembly 200 further includes a sealing strip 202, and the sealing strip 202 may include a U-shaped sealing groove and a sealing edge strip 203 extending along a length direction (the up and down direction shown in FIG. 33) of the U-shaped sealing groove. The U-shaped sealing groove of the sealing strip 202 covers an end portion of the fixed sealing plate group 210 close to the sliding sealing plate group 220, one end of the sealing edge strip 203 is connected with the U-shaped sealing groove and the other end thereof touches with the sliding sealing plate group 220. Thus, the connection sealing property between the sliding sealing plate group 220 and the fixed sealing plate group 210 can be improved.

With the window air conditioner 1000 according to the embodiments of the present invention, by using the sliding sealing plate group 220 slidable with respect to the fixed sealing plate group 210, a position of the sliding sealing plate group 220 can be adjusted according to the installment environment of the window air conditioner 1000, which is convenient for the sealing plate assembly 200 to be suitable for different types of window frames, thus enlarging the application scope of the sealing plate assembly 200, reducing the stock amount of the sealing plate assembly 200, and saving the production cost. In addition, by connecting the fixed sealing plate group 210 with the sliding sealing plate group 220 in the sealing manner, the indoor environment and the outdoor environment are separated effectively, and the heat exchange efficiency between the indoor environment and the outdoor environment is reduced, thus reducing power consumption of the window air conditioner 1000 and saving resources.

Reference throughout this specification to "an embodiment," "some embodiments," "an example," "a specific example," or "some examples," means that a particular feature, structure, material, or characteristic described in connection with the embodiment or example is included in at least one embodiment or example of the present invention. Thus, the appearances of the above phrases throughout this specification are not necessarily referring to the same embodiment or example of the present invention. Furthermore, the particular features, structures, materials, or characteristics may be combined in any suitable manner in one or more embodiments or examples. Those skilled in the art can integrate and combine different embodiments or examples in the specification.

Although embodiments of the present invention have been shown and described, it would be appreciated by those skilled in the art that the above embodiments are explanatory, and cannot be construed to limit the present invention. Those skilled in the art can make changes, modifications, alternatives and variations in the embodiments without departing from the scope of the present invention.

What is claimed is:

1. A window air conditioner, comprising:

an air conditioner body;

a sealing plate assembly disposed at at least one side of the air conditioner body and comprising a fixed sealing plate group and a sliding sealing plate group connected with the fixed sealing plate group in a sealing manner, wherein the fixed sealing plate group is disposed on a side wall of the air conditioner body, and the sliding sealing plate group is disposed at a side of the fixed sealing plate group away from the air conditioner body slidably in a direction approaching to or moving away from the air conditioner body, wherein the fixed sealing plate group comprises one or more sub fixed sealing plates, and the sliding sealing plate group comprises one or more sub sliding sealing plates; and a guiding assembly, wherein the sliding sealing plate group is slidable with respect to the fixed sealing plate group through the guiding assembly, so that the sliding sealing plate group and the fixed sealing plate group can overlap in a front and rear direction, wherein the guiding assembly comprises a fixed guiding portion disposed on the air conditioner body and a sliding guiding portion slidably fitted with the fixed guiding portion, one part of the sliding sealing plate group is fixed in the sliding guiding portion, and the other part of the sliding sealing plate group is connected with the fixed sealing plate group in the sealing manner and slidably fitted with the fixed sealing plate group, wherein the fixed guiding portion comprises a first fixed member connected with the air conditioner body and the fixed sealing plate group by a snap fit connection respectively, and a second fixed member disposed on a top wall and/or a bottom wall of the air conditioner body, the sliding guiding portion being slidably disposed on the second fixed member, wherein the sliding guiding portion comprises:

a first support plate slidably fitted with the fixed guiding portion, wherein the first support plate has a first sliding groove and a second sliding groove disposed side by side along the front and rear direction, and the fixed sealing plate group is slidably fitted within the first sliding groove and the sliding sealing plate group is fixed within the second sliding groove, a second support plate paralleled to the first support plate and spaced apart from the first support plate in an up and down direction, wherein the second support plate is slidably fitted with the fixed guiding portion, and a connecting plate connected between the first support plate and the second support plate, wherein the sliding sealing plate group is connected with the connecting plate by a snap fit connection.

2. The window air conditioner according to claim 1, wherein the first fixed member has a first snap at one side thereof and a second snap at the other side thereof, the first snap is connected with the air conditioner body by a snap fit connection, and the second snap is connected with the fixed sealing plate group by a snap fit connection, the air conditioner body has a first snap groove in the side wall thereof, and the first snap groove is matched with the first snap, the fixed sealing plate group has second snap groove in an end portion thereof opposite to the first fixed member, and the second snap groove is matched with the second snap.

3. The window air conditioner according to claim 2, wherein the first snap comprises two first extending portions spaced apart from each other and extending out from a side of the first fixed member facing the air conditioner body, and each first extending portion has a first snapping member at a free end thereof and two first snapping members extend away from each other, the air conditioner body has two side wings on the side wall thereof, the two side wings are spaced apart from each other and configured to form the first snap groove, and each side wing is configured to have an L shape.

4. The window air conditioner according to claim 2, wherein two second snap grooves are provided and formed in two opposite side walls of the fixed sealing plate group respectively, the second snap comprises two second extending portions spaced apart from each other and extending out from the first fixed member, each of the two second extending portions has a second snapping member at a free end thereof, and the second snapping members are protruded towards each other and matched with the second snap grooves.

5. The window air conditioner according to claim 4, wherein the fixed sealing plate group has an inclined surface between an end surface of the fixed sealing plate group facing the first fixed member and the second snap groove.

6. The window air conditioner according to claim 2, wherein the second snap groove is formed in an end surface of the fixed sealing plate group opposite to the first fixed member, the second snap is configured to be a first protrusion protruded towards the fixed sealing plate group and matched with the second snap groove.

7. The window air conditioner according to claim 6, wherein the first protrusion has opposite side walls fitted with the second snap groove, and in a direction from a fixed end of the first protrusion to a free end of the first protrusion, the opposite side walls are inclined towards each other.

8. The window air conditioner according to claim 7, wherein a first snapping projection is formed on the side wall of the first protrusion fitted with the second snap groove, and a first concave portion fitted with the first snapping projection is provided in a position in the second snap groove opposed to the first snapping projection.

9. The window air conditioner according to claim 1, wherein the second fixed member has a guiding groove extending along a sliding direction of the sliding guiding portion, and the sliding guiding portion has a guiding sliding track matched with the guiding groove.

10. The window air conditioner according to claim 1, wherein the connecting plate has a third snap, the sliding sealing plate group has a third snap groove in an end portion thereof opposite to the connecting plate, and the third snap groove is matched with the third snap.

11. The window air conditioner according to claim 10, wherein two third snap grooves are provided and formed in two opposite side walls of the sliding sealing plate group respectively, the third snap comprises two third extending portions spaced apart from each other and extending out from the connecting plate towards the sliding sealing plate group, each of the two third extending portions has a third snapping member at a free end thereof, and the third snapping members are protruded towards each other and matched with the third snap grooves.

12. The window air conditioner according to claim 10, wherein one third snap groove is provided and formed in an end surface of the sliding sealing plate group opposite to the connecting plate, the third snap is configured to be a second protrusion protruded towards the sliding sealing plate group and matched with the third snap groove.

13. The window air conditioner according to claim 12, wherein the second protrusion has opposite side walls fitted with the third snap groove, and in a direction from a fixed end of the second protrusion to a free end of the second protrusion, the opposite side walls are inclined towards each other.

14. The window air conditioner according to claim 13, wherein a second snapping projection is formed on the side wall of the second protrusion fitted with the third snap groove, and a second concave portion fitted with the second snapping projection is provided in a position in the third snap groove opposed to the second snapping projection.

15. The window air conditioner according to claim 1, wherein the first support plate comprises:

a main plate;

a plurality of side plates disposed at one side of the main plate and configured to define the first sliding groove and the second sliding groove; and a guiding plate disposed at the other side of the main plate and slidably fitted with the fixed guiding portion.

16. The window air conditioner according to claim 1, wherein a sealing assembly is provided between the sliding sealing plate group and the fixed sealing plate group.

17. The window air conditioner according to claim 16, wherein the sealing assembly comprises a sealing protruded strip extending along a length direction of the sliding sealing plate group and disposed on at least one of the sliding sealing plate group and the fixed sealing plate group, and a free end of the sealing protruded strip touches with the corresponding sliding sealing plate group or fixed sealing plate group.

18. The window air conditioner according to claim 16, wherein the sealing assembly is configured to be a sealing strip clamped between the sliding sealing plate group and the fixed sealing plate group, the sealing strip comprises a U-shaped sealing groove, and the U-shaped sealing groove covers an end portion of the sliding sealing plate group toward the fixed sealing plate group or an end portion of the fixed sealing plate group toward the sliding sealing plate group.

19. The window air conditioner according to claim 18, wherein the sealing strip further comprises a sealing edge strip extending along a length direction of the U-shaped sealing groove, and one end of the sealing edge strip is connected with the U-shaped sealing groove and the other end thereof touches with the sliding sealing plate group or the fixed sealing plate group.

20. The window air conditioner according to claim 15, wherein the guiding plate is flush with one of the plurality of side plates.

* * * * *